US009461410B2

(12) United States Patent
Johnescu et al.

(10) Patent No.: US 9,461,410 B2
(45) Date of Patent: Oct. 4, 2016

(54) ELECTRICAL CONNECTOR HAVING RIBBED GROUND PLATE

(71) Applicants: Douglas M. Johnescu, York, PA (US); Jonathan E. Buck, Milpitas, CA (US)

(72) Inventors: Douglas M. Johnescu, York, PA (US); Jonathan E. Buck, Milpitas, CA (US)

(73) Assignee: FCI Americas Technology LLC, Carson City, NV (US)

( * ) Notice: Subject to any disclaimer, the term of this patent is extended or adjusted under 35 U.S.C. 154(b) by 121 days.

(21) Appl. No.: 14/339,769

(22) Filed: Jul. 24, 2014

(65) Prior Publication Data

US 2014/0335707 A1 Nov. 13, 2014

Related U.S. Application Data

(63) Continuation of application No. 13/755,628, filed on Jan. 31, 2013, now Pat. No. 9,048,583, which is a continuation of application No. 12/722,797, filed on Mar. 12, 2010, now Pat. No. 8,366,485.

(60) Provisional application No. 61/161,687, filed on Mar. 19, 2009.

(51) Int. Cl.
*H01R 13/648* (2006.01)
*H01R 13/514* (2006.01)
(Continued)

(52) U.S. Cl.
CPC ..... *H01R 13/648* (2013.01); *H01R 12/724* (2013.01); *H01R 13/514* (2013.01);
(Continued)

(58) Field of Classification Search
CPC ..... H01R 23/688; H01R 23/7073; H01R 23/6873; H01R 13/514; H01R 13/518
USPC ..... 439/607.06–607.09, 108
See application file for complete search history.

(56) References Cited

U.S. PATENT DOCUMENTS 318,186 A 5/1885 Hertzog.
741,052 A 10/1903 Mahon
(Continued)

FOREIGN PATENT DOCUMENTS

DE 1665181 4/1974
DE 3529218 2/1986
(Continued)

OTHER PUBLICATIONS

"1.0 HDMI Right Angle Header Assembly (19 Pin) Lead Free", Molex Incorporated, Jul. 20, 2004, 7 pages.
(Continued)

*Primary Examiner* — Hien Vu
(74) *Attorney, Agent, or Firm* — Wolf, Greenfield & Sacks, P.C.

(57) ABSTRACT

An electrical connector includes a dielectric housing, a plurality of electrical signal contacts carried by the dielectric housing, and a ground plate carried by the dielectric housing. The electrical signal contacts are arranged along a first plane, wherein the signal contacts define signal pairs such that a respective gap is disposed between adjacent signal pairs. The signal contacts further define respective mating and mounting ends. The ground plate includes a ground plate body oriented in a second plane that is substantially parallel to the first plane and offset from the first plane. The ground plate body defines first and second opposed surfaces. The ground plate includes at least one rib that defines first and second opposed surfaces, wherein the first surface of the rib projects from the first surface of the ground plate body in a direction toward the gap, and the second surface is recessed into the second surface of the ground plate body. The ground plate further includes a plurality of mating ends and mounting ends extending from the ground plate body and disposed in the first plane so as to be aligned with the respective mating ends and mounting ends of the electrical signal contacts.

16 Claims, 11 Drawing Sheets

(51) Int. Cl.

| | |
|---|---|
| ***H01R 12/72*** | (2011.01) |
| ***H01R 13/6474*** | (2011.01) |
| ***H01R 13/6586*** | (2011.01) |
| ***H01R 43/18*** | (2006.01) |
| *H01R 13/6587* | (2011.01) |

(52) U.S. Cl.

CPC ..... *H01R13/6474* (2013.01); *H01R 13/6586* (2013.01); *H01R 43/18* (2013.01); *H01R 13/6587* (2013.01); *Y10T 29/49204* (2015.01); *Y10T 29/49208* (2015.01)

(56) References Cited

U.S. PATENT DOCUMENTS

| | | | |
|---|---|---|---|
| 1,477,527 | A | 12/1923 | Raettig |
| D86,515 | S | 3/1932 | Cox |
| 2,231,347 | A | 2/1941 | Reutter |
| 2,248,675 | A | 7/1941 | Huppert |
| 2,430,011 | A | 11/1947 | Gillentine |
| 2,664,552 | A | 12/1953 | Ericsson et al. |
| 2,759,163 | A | 8/1956 | Ustin et al. |
| 2,762,022 | A | 9/1956 | Benander et al. |
| 2,849,700 | A | 4/1958 | Perkin |
| 2,844,644 | A | 7/1958 | Soule, Jr. |
| 2,858,372 | A | 10/1958 | Kaufman |
| 3,011,143 | A | 11/1961 | Dean |
| 3,115,379 | A | 12/1963 | McKee |
| 3,178,669 | A | 4/1965 | Roberts |
| 3,179,738 | A | 4/1965 | De Lyon |
| 3,208,030 | A | 9/1965 | Evans et al. |
| 3,286,220 | A | 11/1966 | Marley et al. |
| 3,320,658 | A | 5/1967 | Bolda et al. |
| 3,343,120 | A | 9/1967 | Whiting |
| 3,366,729 | A | 1/1968 | Pauza |
| 3,411,127 | A | 11/1968 | Adams |
| 3,420,087 | A | 1/1969 | Hatfield et al. |
| D213,697 | S | 4/1969 | Oxley |
| 3,482,201 | A | 12/1969 | Schneck |
| 3,514,740 | A | 5/1970 | Filson et al. |
| 3,538,486 | A | 11/1970 | Shlesinger, Jr. |
| 3,560,908 | A | 2/1971 | Dell et al. |
| 3,591,834 | A | 7/1971 | Kolias |
| 3,634,811 | A | 1/1972 | Teagno |
| 3,641,475 | A | 2/1972 | Irish et al. |
| 3,663,925 | A | 5/1972 | Proctor |
| 3,669,054 | A | 6/1972 | Desso et al. |
| 3,692,994 | A | 9/1972 | Hirschman et al. |
| 3,701,076 | A | 10/1972 | Irish |
| 3,719,981 | A | 3/1973 | Steitz |
| 3,732,697 | A | 5/1973 | Dickson |
| 3,748,633 | A | 7/1973 | Lundergan |
| 3,827,005 | A | 7/1974 | Friend |
| 3,845,451 | A | 10/1974 | Neidecker |
| 3,864,004 | A | 2/1975 | Friend |
| 3,865,462 | A | 2/1975 | Cobaugh et al. |
| 3,867,008 | A | 2/1975 | Gartland, Jr. |
| 3,871,015 | A | 3/1975 | Lin et al. |
| 3,889,364 | A | 6/1975 | Krueger |
| 3,942,856 | A | 3/1976 | Mindheim et al. |
| 3,972,580 | A | 8/1976 | Pemberton et al. |
| 4,030,792 | A | 6/1977 | Fuerst |
| 4,056,302 | A | 11/1977 | Braun et al. |
| 4,070,088 | A | 1/1978 | Vaden |
| 4,076,362 | A | 2/1978 | Ichimura |
| 4,082,407 | A | 4/1978 | Smorzaniuk et al. |
| 4,097,266 | A | 6/1978 | Takahashi et al. |
| 4,136,919 | A | 1/1979 | Howard et al. |
| 4,140,361 | A | 2/1979 | Sochor |
| 4,159,861 | A | 7/1979 | Anhalt |
| 4,217,024 | A | 8/1980 | Aldridge et al. |
| 4,232,924 | A | 11/1980 | Kline et al. |
| 4,260,212 | A | 4/1981 | Ritchie et al. |
| 4,274,700 | A | 6/1981 | Keglewitsch et al. |
| 4,288,139 | A | 9/1981 | Cobaugh et al. |
| 4,371,912 | A | 2/1983 | Guzik |
| 4,380,518 | A | 4/1983 | Wydro, Sr. |
| 4,383,724 | A | 5/1983 | Verhoeven |
| 4,395,086 | A | 7/1983 | Marsh |
| 4,396,140 | A | 8/1983 | Jaffe et al. |
| 4,402,563 | A | 9/1983 | Sinclair |
| 4,403,821 | A | 9/1983 | Zimmerman et al. |
| 4,448,467 | A | 5/1984 | Weidler |
| 4,462,534 | A | 7/1984 | Bitaillou et al. |
| 4,464,003 | A | 8/1984 | Goodman et al. |
| 4,473,113 | A | 9/1984 | Whitfield et al. |
| 4,473,477 | A | 9/1984 | Beall |
| D275,849 | S | 10/1984 | Sakurai |
| 4,482,937 | A | 11/1984 | Berg |
| 4,505,529 | A | 3/1985 | Barkus |
| 4,523,296 | A | 6/1985 | Healy, Jr. |
| 4,533,187 | A | 8/1985 | Kirkman |
| 4,536,955 | A | 8/1985 | Gudgeon |
| 4,545,610 | A | 10/1985 | Lakritz et al. |
| 4,552,425 | A | 11/1985 | Billman |
| 4,560,222 | A | 12/1985 | Dambach |
| 4,564,259 | A | 1/1986 | Vandame |
| 4,592,846 | A | 6/1986 | Metzger et al. |
| 4,596,428 | A | 6/1986 | Tengler |
| 4,596,433 | A | 6/1986 | Oesterheld et al. |
| 4,624,604 | A | 11/1986 | Wagner et al. |
| 4,632,476 | A | 12/1986 | Schell |
| 4,641,426 | A | 2/1987 | Hartman et al. |
| 4,655,515 | A | 4/1987 | Hamsher, Jr. et al. |
| 4,664,309 | A | 5/1987 | Allen et al. |
| 4,664,456 | A | 5/1987 | Blair et al. |
| 4,664,458 | A | 5/1987 | Worth |
| 4,678,250 | A | 7/1987 | Romine et al. |
| 4,685,886 | A | 8/1987 | Denlinger et al. |
| 4,705,205 | A | 11/1987 | Allen et al. |
| 4,705,332 | A | 11/1987 | Sadigh-Behzadi |
| 4,717,360 | A | 1/1988 | Czaja |
| 4,722,470 | A | 2/1988 | Johary |
| 4,762,500 | A | 8/1988 | Dola et al. |
| 4,767,344 | A | 8/1988 | Noschese |
| 4,776,803 | A | 10/1988 | Pretchel et al. |
| 4,782,893 | A | 11/1988 | Thomas |
| 4,790,763 | A | 12/1988 | Weber et al. |
| 4,806,107 | A | 2/1989 | Arnold et al. |
| 4,815,987 | A | 3/1989 | Kawano et al. |
| 4,818,237 | A | 4/1989 | Weber |
| 4,820,169 | A | 4/1989 | Weber et al. |
| 4,820,182 | A | 4/1989 | Harwath et al. |
| 4,824,383 | A | 4/1989 | Lemke |
| 4,830,264 | A | 5/1989 | Bitaillou et al. |
| 4,836,791 | A | 6/1989 | Grabbe et al. |
| 4,844,813 | A | 7/1989 | Helfgott et al. |
| 4,846,727 | A | 7/1989 | Glover et al. |
| 4,850,887 | A | 7/1989 | Sugawara |
| 4,854,899 | A | 8/1989 | Matthews |
| 4,867,713 | A | 9/1989 | Ozu et al. |
| 4,871,110 | A | 10/1989 | Fukasawa et al. |
| 4,878,611 | A | 11/1989 | LoVasco et al. |
| 4,881,905 | A | 11/1989 | Demler et al. |
| 4,882,554 | A | 11/1989 | Akaba et al. |
| 4,884,335 | A | 12/1989 | McCoy et al. |
| 4,898,539 | A | 2/1990 | Glover et al. |
| 4,900,271 | A | 2/1990 | Colleran et al. |
| 4,904,212 | A | 2/1990 | Durbin et al. |
| 4,907,990 | A | 3/1990 | Bertho et al. |
| 4,908,129 | A | 3/1990 | Finsterwalder et al. |
| 4,913,664 | A | 4/1990 | Dixon et al. |
| 4,915,641 | A | 4/1990 | Miskin et al. |
| 4,917,616 | A | 4/1990 | Demler, Jr. et al. |
| 4,952,172 | A | 8/1990 | Barkus et al. |
| 4,963,102 | A | 10/1990 | Gettig et al. |
| 4,965,699 | A | 10/1990 | Jordan et al. |
| 4,973,257 | A | 11/1990 | Lhotak |
| 4,973,271 | A | 11/1990 | Ishizuka et al. |
| 4,974,119 | A | 11/1990 | Martin |
| 4,975,069 | A | 12/1990 | Fedder et al. |
| 4,975,084 | A | 12/1990 | Fedder et al. |
| 4,979,074 | A | 12/1990 | Morley et al. |
| 4,997,390 | A | 3/1991 | Scholz et al. |
| 5,004,426 | A | 4/1991 | Barnett |

(56) References Cited

U.S. PATENT DOCUMENTS 5,016,968 A 5/1991 Hammond et al.
5,024,372 A 6/1991 Altman et al.
5,024,610 A 6/1991 French et al.
5,035,631 A 7/1991 Piorunneck et al.
5,035,639 A 7/1991 Kilpatrick et al.
5,046,960 A 9/1991 Fedder
5,052,953 A 10/1991 Weber
5,055,054 A 10/1991 Doutrich
5,060,844 A 10/1991 Behun et al.
5,065,282 A 11/1991 Polonio
5,066,236 A 11/1991 Broeksteeg
5,077,893 A 1/1992 Mosquera et al.
5,082,459 A 1/1992 Billman et al.
5,083,238 A 1/1992 Bousman
5,093,986 A 3/1992 Mandai et al.
5,094,623 A 3/1992 Scharf et al.
5,094,634 A 3/1992 Dixon et al.
5,098,311 A 3/1992 Roath et al.
5,104,332 A 4/1992 McCoy
5,104,341 A 4/1992 Gilissen et al.
5,111,991 A 5/1992 Clawson et al.
5,117,331 A 5/1992 Gebara
5,118,027 A 6/1992 Braun et al.
5,120,237 A 6/1992 Fussell
5,127,839 A 7/1992 Korsunsky et al.
5,131,871 A 7/1992 Banakis et al.
5,137,959 A 8/1992 Block et al.
5,139,426 A 8/1992 Barkus et al.
5,145,104 A 9/1992 Apap et al.
5,151,056 A 9/1992 McClune
5,152,700 A 10/1992 Bogursky et al.
5,161,987 A 11/1992 Sinisi
5,163,337 A 11/1992 Herron et al.
5,163,849 A 11/1992 Fogg et al.
5,167,528 A 12/1992 Nishiyama et al.
5,169,337 A 12/1992 Ortega et al.
5,174,770 A 12/1992 Sasaki et al.
5,181,855 A 1/1993 Mosquera et al.
5,194,480 A 3/1993 Block et al.
5,199,885 A 4/1993 Korsunsky et al.
5,203,075 A 4/1993 Angulas et al.
5,207,372 A 5/1993 Funari et al.
5,213,868 A 5/1993 Liberty et al.
5,214,308 A 5/1993 Nishiguchi et al.
5,217,381 A 6/1993 Zell et al.
5,222,649 A 6/1993 Funari et al.
5,224,867 A 7/1993 Ohtsuki et al.
5,228,864 A 7/1993 Fusselman et al.
5,229,016 A 7/1993 Hayes et al.
5,238,414 A 8/1993 Yaegashi et al.
5,254,012 A 10/1993 Wang
5,255,839 A 10/1993 Da Costa Alves et al.
5,257,941 A 11/1993 Lwee et al.
5,261,155 A 11/1993 Angulas et al.
5,269,453 A 12/1993 Melton et al.
5,274,918 A 1/1994 Reed
5,275,330 A 1/1994 Isaacs et al.
5,276,964 A 1/1994 Anderson, Jr. et al.
5,277,624 A 1/1994 Champion et al.
5,284,287 A 2/1994 Wilson et al.
5,285,163 A 2/1994 Liotta
5,286,212 A 2/1994 Broeksteeg
5,288,949 A 2/1994 Crafts
5,295,843 A 3/1994 Davis et al.
5,298,791 A 3/1994 Liberty et al.
5,302,135 A 4/1994 Lee
5,321,582 A 6/1994 Casperson
5,324,569 A 6/1994 Nagesh et al.
5,342,211 A 8/1994 Broeksteeg
5,344,327 A 9/1994 Brunker et al.
5,346,118 A 9/1994 Degani et al.
5,354,219 A 10/1994 Wanjura
5,355,283 A 10/1994 Marrs et al.
5,356,300 A 10/1994 Costello et al.
5,356,301 A 10/1994 Champion et al.
5,357,050 A 10/1994 Baran et al.
5,358,417 A 10/1994 Schmedding
5,377,902 A 1/1995 Hayes
5,381,314 A 1/1995 Rudy, Jr. et al.
5,382,168 A 1/1995 Azuma et al.
D355,409 S 2/1995 Krokaugger
5,387,111 A 2/1995 DeSantis et al.
5,387,139 A 2/1995 McKee et al.
5,395,250 A 3/1995 Englert, Jr. et al.
5,400,949 A 3/1995 Hirvonen et al.
5,403,206 A 4/1995 McNamara et al.
5,409,157 A 4/1995 Nagesh et al.
5,410,807 A 5/1995 Bross et al.
5,427,543 A 6/1995 Dynia
5,429,520 A 7/1995 Morlion et al.
5,429,521 A 7/1995 Morlion et al.
5,431,332 A 7/1995 Kirby et al.
5,431,578 A 7/1995 Wayne
5,433,617 A 7/1995 Morlion et al.
5,433,618 A 7/1995 Morlion et al.
5,435,482 A 7/1995 Variot et al.
5,442,852 A 8/1995 Danner
5,445,313 A 8/1995 Boyd et al.
5,457,342 A 10/1995 Herbst, II
5,458,426 A 10/1995 Ito
5,462,456 A 10/1995 Howell
5,467,913 A 11/1995 Namekawa et al.
5,474,472 A 12/1995 Niwa et al.
5,475,922 A 12/1995 Tamura et al.
5,477,933 A 12/1995 Nguyen
5,489,750 A 2/1996 Sakemi et al.
5,490,040 A 2/1996 Gaudenzi et al.
5,491,303 A 2/1996 Weiss
5,492,266 A 2/1996 Hoebener et al.
5,495,668 A 3/1996 Furusawa et al.
5,496,183 A 3/1996 Soes et al.
5,498,167 A 3/1996 Seto et al.
5,499,487 A 3/1996 McGill
5,504,277 A 4/1996 Danner
5,511,987 A 4/1996 Schinchi
5,512,519 A 4/1996 Hwang
5,516,030 A 5/1996 Denton
5,516,032 A 5/1996 Sakemi et al.
5,518,410 A 5/1996 Masami
5,519,580 A 5/1996 Natarajan et al.
5,522,727 A 6/1996 Saito et al.
5,533,915 A 7/1996 Deans
5,534,127 A 7/1996 Sakai
5,539,153 A 7/1996 Schwiebert et al.
5,542,174 A 8/1996 Chiu
5,558,542 A 9/1996 O'Sullivan et al.
5,564,952 A 10/1996 Davis et al.
5,575,688 A 11/1996 Crane, Jr.
5,577,928 A 11/1996 Duclos
5,580,283 A 12/1996 O'Sullivan et al.
5,586,908 A 12/1996 Lorrain
5,586,914 A 12/1996 Foster, Jr. et al.
5,588,859 A 12/1996 Maurice
5,590,463 A 1/1997 Feldman et al.
5,591,118 A 1/1997 Bierck
5,591,941 A 1/1997 Acocella et al.
5,593,322 A 1/1997 Swamy et al.
5,605,417 A 2/1997 Englert et al.
5,609,502 A 3/1997 Thumma
5,613,882 A 3/1997 Hnatuck et al.
5,618,187 A 4/1997 Goto
5,634,821 A 6/1997 Crane, Jr.
5,637,008 A 6/1997 Kozel
5,637,019 A 6/1997 Crane, Jr. et al.
5,643,009 A 7/1997 Dinkel et al.
5,664,968 A 9/1997 Mickievicz
5,664,973 A 9/1997 Emmert et al.
5,667,392 A 9/1997 Kocher et al.
5,672,064 A 9/1997 Provencher et al.
5,691,041 A 11/1997 Frankeny et al.
D387,733 S 12/1997 Lee
5,697,799 A 12/1997 Consoli et al.
5,702,255 A 12/1997 Murphy et al.
5,713,746 A 2/1998 Olson et al.

(56) References Cited

U.S. PATENT DOCUMENTS 5,718,606 A 2/1998 Rigby et al.
5,727,963 A 3/1998 LeMaster
5,730,609 A 3/1998 Harwath
5,733,453 A 3/1998 DeBusk
5,741,144 A 4/1998 Elco et al.
5,741,161 A 4/1998 Cahaly et al.
5,742,484 A 4/1998 Gillette et al.
5,743,009 A 4/1998 Matsui et al.
5,743,765 A 4/1998 Andrews et al.
5,745,349 A 4/1998 Lemke
5,746,608 A 5/1998 Taylor
5,749,746 A 5/1998 Tan et al.
5,755,595 A 5/1998 Davis et al.
5,766,023 A 6/1998 Noschese et al.
5,772,451 A 6/1998 Dozier, II et al.
5,782,644 A 7/1998 Kiat
5,787,971 A 8/1998 Dodson
5,795,191 A 8/1998 Preputnick et al.
5,810,607 A 9/1998 Shih et al.
5,817,973 A 10/1998 Elco
5,827,094 A 10/1998 Aizawa et al.
5,831,314 A 11/1998 Wen
5,833,475 A 11/1998 Mitra
5,846,024 A 12/1998 Mao et al.
5,851,121 A 12/1998 Thenaisie et al.
5,853,797 A 12/1998 Fuchs et al.
5,857,857 A 1/1999 Fukuda
5,860,816 A 1/1999 Provencher et al.
5,871,362 A 2/1999 Campbell et al.
5,874,776 A 2/1999 Kresge et al.
5,876,219 A 3/1999 Taylor et al.
5,876,222 A 3/1999 Gardner et al.
5,876,248 A 3/1999 Brunker et al.
5,882,214 A 3/1999 Hillbish et al.
5,883,782 A 3/1999 Thurston et al.
5,887,158 A 3/1999 Sample et al.
5,888,884 A 3/1999 Wojnarowski
5,892,791 A 4/1999 Moon
5,893,761 A 4/1999 Longueville
5,902,136 A 5/1999 Lemke et al.
5,904,581 A 5/1999 Pope et al.
5,908,333 A 6/1999 Perino et al.
5,913,702 A 6/1999 Garcin
5,919,050 A 7/1999 Kehley et al.
5,930,114 A 7/1999 Kuzmin et al.
5,938,479 A 8/1999 Paulson et al.
5,943,770 A 8/1999 Thenaisie et al.
5,955,888 A 9/1999 Frederickson et al.
5,961,355 A 10/1999 Morlion et al.
5,967,844 A 10/1999 Doutrich et al.
5,971,817 A 10/1999 Longueville
5,975,921 A 11/1999 Shuey
5,980,270 A 11/1999 Fjelstad et al.
5,980,321 A 11/1999 Cohen et al.
5,982,249 A 11/1999 Bruns
5,984,690 A 11/1999 Riechelmann et al.
5,984,726 A 11/1999 Wu
5,992,953 A 11/1999 Rabinovitz
5,993,259 A 11/1999 Stokoe et al.
6,012,948 A 1/2000 Wu
6,022,227 A 2/2000 Huang
6,024,584 A 2/2000 Lemke et al.
6,027,381 A 2/2000 Lok
6,036,549 A 3/2000 Wulff
6,041,498 A 3/2000 Hillbish et al.
6,042,389 A 3/2000 Lemke et al.
6,042,394 A 3/2000 Mitra et al.
6,042,427 A 3/2000 Adriaenssens et al.
6,050,842 A 4/2000 Ferrill et al.
6,050,862 A 4/2000 Ishii
6,053,751 A 4/2000 Humphrey
6,059,170 A 5/2000 Jimarez et al.
6,066,048 A 5/2000 Lees
6,068,520 A 5/2000 Winings et al.
6,071,152 A 6/2000 Achammer et al.
6,077,130 A 6/2000 Hughes et al.
6,083,047 A 7/2000 Paagman
6,086,386 A 7/2000 Fjelstad et al.
6,089,878 A 7/2000 Meng
6,095,827 A 8/2000 Dutkowsky et al.
6,113,418 A 9/2000 Kjeldahl
6,116,926 A 9/2000 Ortega et al.
6,116,965 A 9/2000 Arnett et al.
6,123,554 A 9/2000 Ortega et al.
6,125,535 A 10/2000 Chiou et al.
6,129,592 A 10/2000 Mickievicz et al.
6,132,255 A 10/2000 Verhoeven
6,139,336 A 10/2000 Olson
6,146,157 A 11/2000 Lenoir et al.
6,146,202 A 11/2000 Ramey et al.
6,146,203 A 11/2000 Elco et al.
6,152,747 A 11/2000 McNamara
6,152,756 A 11/2000 Huang et al.
6,154,742 A 11/2000 Herriot
6,171,115 B1 1/2001 Mickievicz et al.
6,171,149 B1 1/2001 Van Zanten
6,174,198 B1 1/2001 Wu et al.
6,179,663 B1 1/2001 Bradley et al.
6,180,891 B1 1/2001 Murdeshwar
6,183,287 B1 2/2001 Po
6,183,301 B1 2/2001 Paagman
6,190,213 B1 2/2001 Reichart et al.
6,193,537 B1 2/2001 Harper, Jr. et al.
6,196,871 B1 3/2001 Szu
6,202,916 B1 3/2001 Updike et al.
6,206,722 B1 3/2001 Ko et al.
6,206,735 B1 3/2001 Zanolli
6,210,197 B1 4/2001 Yu
6,210,240 B1 4/2001 Comerci et al.
6,212,755 B1 4/2001 Shimada et al.
6,215,180 B1 4/2001 Chen et al.
6,219,913 B1 4/2001 Uchiyama
6,220,884 B1 4/2001 Lin
6,220,895 B1 4/2001 Lin
6,220,896 B1 4/2001 Bertoncini et al.
6,227,882 B1 5/2001 Ortega et al.
6,231,391 B1 5/2001 Ramey et al.
6,234,851 B1 5/2001 Phillips
6,238,225 B1 5/2001 Middlehurst et al.
6,241,535 B1 6/2001 Lemke et al.
6,244,887 B1 6/2001 Commerci et al.
6,257,478 B1 7/2001 Straub
6,259,039 B1 7/2001 Chroneos, Jr. et al.
6,261,132 B1 7/2001 Koseki et al.
6,267,604 B1 7/2001 Mickievicz et al.
6,269,539 B1 8/2001 Takahashi et al.
6,274,474 B1 8/2001 Caletka et al.
6,280,209 B1 8/2001 Bassler et al.
6,280,230 B1 8/2001 Takase et al.
6,280,809 B1 8/2001 Wang
6,290,552 B1 9/2001 Saito et al.
6,293,827 B1 9/2001 Stokoe
6,299,483 B1 10/2001 Cohen et al.
6,299,484 B2 10/2001 Van Woensel et al.
6,299,492 B1 10/2001 Pierini et al.
6,302,711 B1 10/2001 Ito
6,309,245 B1 10/2001 Sweeney
6,319,075 B1 11/2001 Clark et al.
6,322,377 B2 11/2001 Middlehurst et al.
6,322,379 B1 11/2001 Ortega et al.
6,322,393 B1 11/2001 Doutrich et al.
6,328,602 B1 12/2001 Yamasaki et al.
6,338,635 B1 1/2002 Lee
6,343,955 B2 2/2002 Billman et al.
6,347,952 B1 2/2002 Hasegawa et al.
6,347,962 B1 2/2002 Kline
6,350,134 B1 2/2002 Fogg et al.
6,354,877 B1 3/2002 Shuey et al.
6,358,061 B1 3/2002 Regnier
6,359,783 B1 3/2002 Noble
6,360,940 B1 3/2002 Bolde et al.
6,361,366 B1 3/2002 Shuey et al.
6,361,376 B1 3/2002 Onoda
6,362,961 B1 3/2002 Chiou

(56) References Cited

U.S. PATENT DOCUMENTS 6,363,607 B1 4/2002 Chen et al.
6,364,710 B1 4/2002 Billman et al.
6,371,773 B1 4/2002 Crofoot et al.
6,371,813 B2 4/2002 Ramey et al.
6,375,478 B1 4/2002 Kikuchi
6,375,508 B1 4/2002 Pickles et al.
6,379,188 B1 4/2002 Cohen et al.
6,386,914 B1 5/2002 Collins et al.
6,386,924 B2 5/2002 Long
6,390,826 B1 5/2002 Affolter et al.
6,394,818 B1 5/2002 Smalley, Jr.
6,402,566 B1 6/2002 Middlehurst et al.
6,409,543 B1 6/2002 Astbury, Jr. et al.
6,414,248 B1 7/2002 Sundstrom
6,420,778 B1 7/2002 Sinyansky
6,425,785 B1 7/2002 Azuma
6,428,328 B2 8/2002 Haba et al.
6,431,914 B1 8/2002 Billman
6,431,921 B2 8/2002 Saito et al.
6,435,914 B1 8/2002 Billman
6,450,829 B1 9/2002 Weisz-Margulescu
6,457,983 B1 10/2002 Bassler et al.
6,461,183 B1 10/2002 Ohkita et al.
6,461,202 B2 10/2002 Kline
6,464,529 B1 10/2002 Jensen et al.
6,471,523 B1 10/2002 Shuey
6,471,548 B2 10/2002 Bertoncini et al.
6,472,474 B2 10/2002 Burkhardt et al.
6,482,038 B2 11/2002 Olson
6,485,330 B1 11/2002 Doutrich
6,488,549 B1 12/2002 Weller et al.
6,489,567 B2 12/2002 Zachrai
6,491,545 B1 12/2002 Spiegel et al.
6,494,734 B1 12/2002 Shuey
6,503,103 B1 1/2003 Cohen et al.
6,506,076 B2 1/2003 Cohen et al.
6,506,081 B2 1/2003 Blanchfield et al.
6,517,360 B1 2/2003 Cohen
6,520,803 B1 2/2003 Dunn
6,526,519 B1 2/2003 Cuthbert
6,527,587 B1 3/2003 Ortega et al.
6,527,588 B2 3/2003 Paagman
6,528,737 B1 3/2003 Kwong et al.
6,530,134 B1 3/2003 Laphan et al.
6,537,086 B1 3/2003 Mac Mullin
6,537,111 B2 3/2003 Brammer et al.
6,540,522 B2 4/2003 Sipe
6,540,558 B1 4/2003 Paagman
6,540,559 B1 4/2003 Kemmick et al.
6,544,046 B1 4/2003 Hahn et al.
6,544,072 B2 4/2003 Olson
6,547,066 B2 4/2003 Koch
6,551,112 B1 4/2003 Li et al.
6,551,140 B2 * 4/2003 Billman ..... H01R 13/514 439/607.07
6,554,647 B1 4/2003 Cohen et al.
6,565,387 B2 5/2003 Cohen
6,565,388 B1 5/2003 Van Woensel et al.
6,572,409 B2 6/2003 Nitta et al.
6,572,410 B1 6/2003 Volstorf et al.
6,575,774 B2 6/2003 Ling et al.
6,575,776 B1 6/2003 Conner et al.
6,589,071 B1 7/2003 Lias et al.
6,592,381 B2 7/2003 Cohen et al.
6,602,095 B2 8/2003 Astbury, Jr. et al.
6,604,967 B2 8/2003 Middlehurst et al.
6,607,402 B2 8/2003 Cohen et al.
6,623,310 B1 9/2003 Billman et al.
6,629,854 B2 10/2003 Murakami
6,633,490 B2 10/2003 Centola et al.
6,641,410 B2 11/2003 Marvin et al.
6,641,411 B1 11/2003 Stoddard et al.
6,641,825 B2 11/2003 Scholz et al.
6,652,318 B1 11/2003 Winings et al.
6,663,426 B2 12/2003 Hasircoglu et al.
6,665,189 B1 12/2003 Lebo
6,666,693 B2 12/2003 Belopolsky et al.
6,669,514 B2 12/2003 Weibking et al.
6,672,884 B1 1/2004 Toh et al.
6,672,907 B2 1/2004 Azuma
6,679,709 B2 1/2004 Takeuchi
6,692,272 B2 2/2004 Lemke et al.
6,695,627 B2 2/2004 Ortega et al.
6,702,590 B2 3/2004 Zaderej et al.
6,702,594 B2 3/2004 Lee et al.
6,705,902 B1 3/2004 Yi et al.
6,709,294 B1 3/2004 Cohen et al.
6,712,621 B2 3/2004 Li et al.
6,712,646 B2 3/2004 Shindo
6,716,045 B2 4/2004 Meredith
6,716,068 B2 4/2004 Wu
6,717,825 B2 4/2004 Volstorf
6,726,492 B1 4/2004 Yu
6,736,664 B2 5/2004 Ueda et al.
6,739,910 B1 5/2004 Wu
6,740,820 B2 5/2004 Cheng
D492,295 S 6/2004 Glatt
6,743,037 B2 6/2004 Kassa et al.
6,743,059 B1 6/2004 Korsunsky et al.
6,746,278 B2 * 6/2004 Nelson ..... H01R 13/518 439/607.07
6,749,439 B1 6/2004 Potter et al.
6,762,067 B1 7/2004 Quinones et al.
6,764,341 B2 7/2004 Lappoehn
6,769,883 B2 8/2004 Brid et al.
6,769,935 B2 8/2004 Stokoe et al.
6,776,635 B2 8/2004 Blanchfield et al.
6,776,649 B2 8/2004 Pape et al.
6,780,027 B2 8/2004 Allison et al.
6,786,771 B2 9/2004 Gailus
6,790,088 B2 9/2004 Ono et al.
6,796,831 B1 9/2004 Yasufuku et al.
6,797,215 B2 9/2004 Bonk et al.
6,799,215 B1 9/2004 Giroir et al.
D497,343 S 10/2004 Busse et al.
6,805,278 B1 10/2004 Olson et al.
6,808,399 B2 10/2004 Rothermel et al.
6,808,420 B2 10/2004 Whiteman, Jr. et al.
6,810,783 B1 11/2004 Larose
6,811,440 B1 11/2004 Rothermel et al.
6,814,590 B2 11/2004 Minich et al.
6,814,619 B1 11/2004 Stokoe et al.
6,824,391 B2 11/2004 Mickievicz et al.
6,829,143 B2 12/2004 Russell et al.
6,835,072 B2 12/2004 Simons et al.
6,835,103 B2 12/2004 Middlehurst et al.
6,843,686 B2 1/2005 Ohnishi et al.
6,843,687 B2 1/2005 McGowan et al.
6,848,886 B2 2/2005 Schmaling et al.
6,848,944 B2 2/2005 Evans
6,848,950 B2 2/2005 Allison et al.
6,848,953 B2 2/2005 Schell et al.
6,851,974 B2 2/2005 Doutrich
6,851,980 B2 2/2005 Nelson et al.
6,852,567 B1 2/2005 Lee et al.
D502,919 S 3/2005 Studnicky, III
6,866,549 B2 3/2005 Kimura et al.
6,869,292 B2 3/2005 Johnescu et al.
6,872,085 B1 3/2005 Cohen et al.
6,884,117 B2 4/2005 Korsunsky et al.
6,890,214 B2 5/2005 Brown et al.
6,890,221 B2 5/2005 Wagner
6,893,272 B2 5/2005 Yu
6,893,300 B2 5/2005 Zhou et al.
6,893,686 B2 5/2005 Egan
6,899,566 B2 5/2005 Kline et al.
6,902,411 B2 6/2005 Kubo
6,905,367 B2 6/2005 Crane, Jr. et al.
6,913,490 B2 7/2005 Whiteman, Jr. et al.
6,918,776 B2 7/2005 Spink, Jr.
6,918,789 B2 7/2005 Lang et al.
6,929,504 B2 8/2005 Ling et al.
6,932,649 B1 8/2005 Rothermel et al.
6,939,173 B1 9/2005 Elco et al.

(56) References Cited

U.S. PATENT DOCUMENTS 6,945,796 B2 9/2005 Bassler et al.
6,947,012 B2 9/2005 Aisenbrey
6,951,466 B2 10/2005 Sandoval et al.
6,953,351 B2 10/2005 Fromm et al.
6,969,268 B2 11/2005 Brunker
6,969,280 B2 11/2005 Chien et al.
6,975,511 B1 12/2005 Lebo et al.
6,976,886 B2 12/2005 Winings et al.
6,979,202 B2 12/2005 Benham et al.
6,979,215 B2 12/2005 Avery et al.
6,981,883 B2 1/2006 Raistrick et al.
6,988,902 B2 1/2006 Winings et al.
6,994,569 B2 2/2006 Minich et al.
7,001,189 B1 2/2006 McGowan et al.
7,021,975 B2 4/2006 Lappohn
7,040,901 B2 5/2006 Benham et al.
7,044,794 B2 5/2006 Consoli et al.
7,059,892 B1 6/2006 Trout
7,059,919 B2 6/2006 Clark et al.
7,065,871 B2 6/2006 Minich et al.
7,070,464 B2 7/2006 Clark et al.
7,074,096 B2 7/2006 Copper et al.
7,086,147 B2 8/2006 Caletka et al.
7,090,501 B1 8/2006 Scherer et al.
7,094,102 B2 8/2006 Cohen et al.
7,097,465 B1 8/2006 Korsunsky et al.
7,097,506 B2 8/2006 Nakada
7,101,191 B2 9/2006 Benham et al.
7,101,228 B2 9/2006 Hamner et al.
7,104,812 B1 9/2006 Bogiel et al.
7,108,556 B2 9/2006 Cohen et al.
7,114,963 B2 10/2006 Shuey et al.
7,114,964 B2 10/2006 Winings et al.
7,118,391 B2 10/2006 Minich et al.
RE39,380 E 11/2006 Davis
7,131,870 B2 11/2006 Whiteman, Jr. et al.
7,137,848 B1 11/2006 Trout et al.
7,153,162 B2 12/2006 Mizumura et al.
7,160,151 B1 1/2007 Rigby et al.
7,163,421 B1 1/2007 Cohen et al.
7,168,963 B2 1/2007 Minich et al.
7,172,461 B2 2/2007 Davis et al.
7,182,642 B2 2/2007 Ngo et al.
7,182,643 B2 2/2007 Winings et al.
D540,258 S 4/2007 Peng et al.
7,204,699 B2 4/2007 Stoner et al.
7,207,807 B2 4/2007 Fogg
D541,748 S 5/2007 Peng et al
D542,736 S 5/2007 Riku
7,220,141 B2 5/2007 Daily et al.
7,239,526 B1 7/2007 Bibee
7,241,168 B2 7/2007 Sakurai et al.
7,258,562 B2 8/2007 Daily et al.
D550,158 S 9/2007 Victor
D550,628 S 9/2007 Whiteman, Jr. et al.
7,267,515 B2 9/2007 Lappöhn
7,270,574 B1 9/2007 Ngo
7,273,382 B2 9/2007 Igarashi et al.
7,278,856 B2 10/2007 Minich
7,281,950 B2 10/2007 Belopolsky
D554,591 S 11/2007 Victor
7,292,055 B2 11/2007 Egitto
7,303,427 B2 12/2007 Swain
7,309,239 B2 12/2007 Shuey et al.
7,316,585 B2 1/2008 Smith et al.
7,322,855 B2 1/2008 Mongold et al.
7,331,802 B2 2/2008 Rothermel et al.
7,335,043 B2 2/2008 Hgo et al.
7,338,321 B2 3/2008 Laurx
7,347,740 B2 3/2008 Minich
7,351,071 B2 4/2008 Korsunsky et al.
7,381,092 B2 6/2008 Nakada
7,384,289 B2 6/2008 Minich
7,384,311 B2 6/2008 Sharf et al.
7,402,064 B2 7/2008 Daily
7,407,387 B2 8/2008 Johnescu
7,422,483 B2 9/2008 Avery et al.
7,425,145 B2 9/2008 Ngo et al.
7,429,176 B2 9/2008 Johnescu
7,445,457 B1 11/2008 Frangioso, Jr. et al.
7,452,242 B2 11/2008 Poh et al.
7,452,249 B2 11/2008 Daily
7,458,839 B2 12/2008 Ngo
7,467,955 B2 12/2008 Raistrick et al.
7,476,108 B2 1/2009 Swain
7,497,735 B2 3/2009 Belopolsky
7,497,736 B2 3/2009 Minich et al.
7,500,871 B2 3/2009 Minich et al.
7,503,804 B2 3/2009 Minich
7,541,135 B2 6/2009 Swain
7,549,897 B2 6/2009 Fedder et al.
7,553,182 B2 6/2009 Buck et al.
7,588,463 B2 9/2009 Yamada et al.
7,621,781 B2 11/2009 Rothermel et al.
D607,822 S 1/2010 Dennes
D611,908 S 3/2010 Takada et al.
7,708,569 B2 5/2010 Sercu et al.
D618,180 S 6/2010 Gross et al.
D618,181 S 6/2010 Gross et al.
7,753,731 B2 7/2010 Cohen et al.
7,762,843 B2 7/2010 Minich et al.
D626,075 S 10/2010 Truskett et al.
7,833,065 B2 11/2010 Lin et al.
D628,963 S 12/2010 Sau et al.
7,883,366 B2 2/2011 Davis et al.
7,976,326 B2 7/2011 Stoner
7,988,456 B2 8/2011 Davis et al.
8,011,957 B2 9/2011 Pan
D651,177 S 12/2011 Luo
8,079,847 B2 12/2011 Davis et al.
D653,621 S 2/2012 Gross et al.
8,109,770 B2 2/2012 Perugini et al.
8,119,926 B2 2/2012 Murphy
8,157,599 B2 4/2012 Wei
8,231,415 B2 7/2012 Johnescu et al.
8,277,241 B2 10/2012 Horchler et al.
8,366,485 B2 2/2013 Johnescu
8,408,939 B2 4/2013 Davis et al.
8,414,199 B2 4/2013 Ishigami
8,465,213 B2 6/2013 Tamura et al.
8,480,413 B2 7/2013 Minich et al.
RE44,556 E 10/2013 Minich
D712,843 S 9/2014 Buck et al.
2001/0003685 A1 6/2001 Aritani
2001/0008189 A1 7/2001 Reede
2001/0012729 A1 8/2001 Van Woensel
2001/0041477 A1 11/2001 Billman et al.
2001/0046810 A1* 11/2001 Cohen ..... H01R 23/688 439/607.09
2001/0046816 A1 11/2001 Saito et al.
2002/0013101 A1 1/2002 Long
2002/0039857 A1 4/2002 Naito et al.
2002/0084105 A1 7/2002 Geng et al.
2002/0098727 A1 7/2002 McNamara et al.
2002/0106930 A1 8/2002 Pape et al.
2002/0106932 A1 8/2002 Holland et al.
2002/0111068 A1 8/2002 Cohen et al.
2002/0127903 A1 9/2002 Billman et al.
2002/0142629 A1 10/2002 Zaderej et al.
2002/0142676 A1 10/2002 Hosaka et al.
2002/0159235 A1 10/2002 Miller et al.
2002/0173177 A1 11/2002 Korsunsky et al.
2002/0187688 A1 12/2002 Marvin et al.
2002/0193019 A1 12/2002 Blanchfield et al.
2003/0116857 A1 6/2003 Taniguchi et al.
2003/0119378 A1 6/2003 Avery
2003/0143894 A1 7/2003 Kline et al.
2003/0171010 A1 9/2003 Winings et al.
2003/0203665 A1 10/2003 Ohnishi et al.
2003/0219999 A1 11/2003 Minich et al.
2003/0220021 A1 11/2003 Whiteman, Jr. et al.
2003/0236035 A1 12/2003 Kuroda et al.
2004/0018757 A1 1/2004 Lang et al.
2004/0038590 A1 2/2004 Lang et al.

(56) References Cited

U.S. PATENT DOCUMENTS

| | | | |
|---|---|---|---|
| 2004/0072470 | A1 | 4/2004 | Lang et al. |
| 2004/0077224 | A1 | 4/2004 | Marchese |
| 2004/0087196 | A1 | 5/2004 | Lang et al. |
| 2004/0114866 | A1 | 6/2004 | Hiramatsu |
| 2004/0157477 | A1 | 8/2004 | Johnson et al. |
| 2004/0224559 | A1 | 11/2004 | Nelson et al. |
| 2004/0235321 | A1 | 11/2004 | Mizumura et al. |
| 2004/0259420 | A1 | 12/2004 | Wu |
| 2005/0009402 | A1 | 1/2005 | Chien et al. |
| 2005/0026503 | A1 | 2/2005 | Trout et al. |
| 2005/0032401 | A1 | 2/2005 | Kobayashi |
| 2005/0048838 | A1 | 3/2005 | Korsunsky et al. |
| 2005/0079763 | A1 | 4/2005 | Lemke et al. |
| 2005/0101166 | A1 | 5/2005 | Kameyama |
| 2005/0101188 | A1 | 5/2005 | Benham et al. |
| 2005/0112952 | A1 | 5/2005 | Wang et al. |
| 2005/0118869 | A1 | 6/2005 | Evans |
| 2005/0170700 | A1 | 8/2005 | Shuey et al. |
| 2005/0196987 | A1 | 9/2005 | Shuey et al. |
| 2005/0202722 | A1 | 9/2005 | Regnier et al. |
| 2005/0215121 | A1 | 9/2005 | Tokunaga |
| 2005/0227552 | A1 | 10/2005 | Yamashita et al. |
| 2005/0277315 | A1 | 12/2005 | Mongold et al. |
| 2005/0287869 | A1 | 12/2005 | Kenny et al. |
| 2006/0003620 | A1 | 1/2006 | Daily et al. |
| 2006/0014433 | A1 | 1/2006 | Consoli et al. |
| 2006/0024983 | A1 | 2/2006 | Cohen et al. |
| 2006/0024984 | A1 | 2/2006 | Cohen et al. |
| 2006/0046526 | A1 | 3/2006 | Minich |
| 2006/0051987 | A1 | 3/2006 | Goodman et al. |
| 2006/0068610 | A1 | 3/2006 | Belopolsky |
| 2006/0068641 | A1 | 3/2006 | Hull et al. |
| 2006/0073709 | A1 | 4/2006 | Reid |
| 2006/0116857 | A1 | 6/2006 | Sevic et al. |
| 2006/0121749 | A1 | 6/2006 | Fogg |
| 2006/0128197 | A1 | 6/2006 | McGowan et al. |
| 2006/0141818 | A1 | 6/2006 | Ngo |
| 2006/0183377 | A1 | 8/2006 | Sinsheimer |
| 2006/0192274 | A1 | 8/2006 | Lee et al. |
| 2006/0216969 | A1 | 9/2006 | Bright et al. |
| 2006/0228912 | A1 | 10/2006 | Morlion et al. |
| 2006/0232301 | A1 | 10/2006 | Morlion et al. |
| 2006/0281354 | A1 | 12/2006 | Ngo et al. |
| 2007/0004287 | A1 | 1/2007 | Marshall |
| 2007/0021002 | A1 | 1/2007 | Laurx et al. |
| 2007/0042639 | A1 | 2/2007 | Manter et al. |
| 2007/0071391 | A1 | 3/2007 | Mazotti et al. |
| 2007/0099455 | A1 | 5/2007 | Rothermel et al. |
| 2007/0099512 | A1 | 5/2007 | Sato |
| 2007/0183707 | A1 | 8/2007 | Umezawa |
| 2007/0183724 | A1 | 8/2007 | Sato |
| 2007/0202715 | A1 | 8/2007 | Daily et al. |
| 2007/0202747 | A1 | 8/2007 | Sharf et al. |
| 2007/0205774 | A1 | 9/2007 | Minich |
| 2007/0207641 | A1 | 9/2007 | Minich |
| 2007/0293084 | A1 | 12/2007 | Ngo |
| 2008/0032524 | A1 | 2/2008 | Lemke et al. |
| 2008/0045079 | A1 | 2/2008 | Minich et al. |
| 2008/0176453 | A1 | 7/2008 | Minich et al. |
| 2008/0232737 | A1 | 9/2008 | Ishigami et al. |
| 2008/0246555 | A1 | 10/2008 | Kirk et al. |
| 2008/0248670 | A1 | 10/2008 | Daily et al. |
| 2008/0316729 | A1 | 12/2008 | Rothermel et al. |
| 2009/0011643 | A1 | 1/2009 | Amleshi et al. |
| 2010/0055983 | A1 | 3/2010 | Wu |
| 2010/0093209 | A1 | 4/2010 | Liu et al. |
| 2010/0216342 | A1 | 8/2010 | Lin |
| 2010/0240233 | A1 | 9/2010 | Johnescu et al. |
| 2010/0291803 | A1 | 11/2010 | Kirk |
| 2011/0097934 | A1 | 4/2011 | Minich |
| 2011/0159744 | A1 | 6/2011 | Buck |
| 2011/0195593 | A1 | 8/2011 | McGrath et al. |
| 2012/0202363 | A1 | 8/2012 | McNamara et al. |
| 2012/0214343 | A1 | 8/2012 | Buck et al. |
| 2012/0289095 | A1 | 11/2012 | Kirk |
| 2013/0005160 | A1 | 1/2013 | Minich |
| 2013/0090025 | A1 | 4/2013 | Trout et al. |
| 2013/0122744 | A1 | 5/2013 | Morgan et al. |
| 2013/0149890 | A1 | 6/2013 | Schroll et al. |
| 2013/0195408 | A1 | 8/2013 | Hermeline et al. |
| 2013/0210246 | A1 | 8/2013 | Davis et al. |
| 2013/0273756 | A1 | 10/2013 | Stoner |
| 2013/0273781 | A1 | 10/2013 | Buck et al. |
| 2014/0017957 | A1 | 1/2014 | Horchler et al. |
| 2014/0227911 | A1 | 8/2014 | Lim et al. |

FOREIGN PATENT DOCUMENTS

| | | |
|---|---|---|
| DE | 3605316 | 8/1987 |
| DE | 4040551 | 6/1991 |
| DE | 10226279 | 11/2003 |
| DE | 102010005001 | 8/2010 |
| EP | 0212764 | 3/1987 |
| EP | 0273683 | 7/1988 |
| EP | 0337634 | 10/1989 |
| EP | 0442785 | 8/1991 |
| EP | 0486298 | 5/1992 |
| EP | 0321257 | 4/1993 |
| EP | 0560550 | 9/1993 |
| EP | 0562691 | 9/1993 |
| EP | 0591772 | 4/1994 |
| EP | 0623248 | 11/1995 |
| EP | 0706240 | 4/1996 |
| EP | 0782220 | 7/1997 |
| EP | 0789422 | 8/1997 |
| EP | 0843383 | 5/1998 |
| EP | 0635910 | 6/2000 |
| EP | 1024556 | 8/2000 |
| EP | 1111730 | 6/2001 |
| EP | 0891016 | 10/2002 |
| EP | 1091449 | 9/2004 |
| EP | 1148587 | 4/2005 |
| GB | 1162705 | 8/1969 |
| JP | 57/058115 | 4/1982 |
| JP | 60/072663 | 4/1985 |
| JP | 02/278893 | 11/1990 |
| JP | 0521119 | 1/1993 |
| JP | 05344728 | 12/1993 |
| JP | 0668943 | 3/1994 |
| JP | 6236788 | 8/1994 |
| JP | 7114958 | 5/1995 |
| JP | 07169523 | 7/1995 |
| JP | 0896918 | 4/1996 |
| JP | 08125379 | 5/1996 |
| JP | 09199215 | 7/1997 |
| JP | 11185886 | 7/1999 |
| JP | 2000/003743 | 1/2000 |
| JP | 2000/003744 | 1/2000 |
| JP | 2000/003745 | 1/2000 |
| JP | 2000/003746 | 1/2000 |
| JP | 2000/228243 | 8/2000 |
| JP | 2001/135388 | 5/2001 |
| JP | 2001/305182 | 10/2001 |
| JP | 2002/008790 | 1/2002 |
| JP | 2003/217785 | 7/2003 |
| JP | 2007/128706 | 5/2007 |
| KR | 100517561 | 9/2005 |
| TW | 576555 | 8/1990 |
| TW | 546872 | 8/2003 |
| WO | WO 90/16093 | 12/1990 |
| WO | WO 96/38889 | 12/1996 |
| WO | WO 96/42123 | 12/1996 |
| WO | WO 97/20454 | 6/1997 |
| WO | WO 97/43885 | 11/1997 |
| WO | WO 97/44859 | 11/1997 |
| WO | WO 97/45896 | 12/1997 |
| WO | WO 98/15989 | 4/1998 |
| WO | WO 00/16445 | 3/2000 |
| WO | WO 01/29931 | 4/2001 |
| WO | WO 01/39332 | 5/2001 |
| WO | WO 02/058191 | 7/2002 |
| WO | WO 02/101882 | 12/2002 |
| WO | WO 02/103847 | 12/2002 |
| WO | WO 2005/065254 | 7/2005 |

(56) References Cited

FOREIGN PATENT DOCUMENTS

| | | |
|---|---|---|
| WO | WO 2006/031296 | 3/2006 |
| WO | WO 2006/105535 | 10/2006 |
| WO | WO 2007/064632 | 6/2007 |
| WO | WO 2008/082548 | 7/2008 |
| WO | WO 2008/117180 | 10/2008 |
| WO | WO 2008/156851 | 12/2008 |
| WO | WO 2011/059872 | 5/2011 |
| WO | WO 2012/047619 | 4/2012 |
| WO | WO 2012/174120 | 12/2012 |

OTHER PUBLICATIONS

"1.90 by 1.35mm (.075 by.053) Pitch Impact, Backplane Connector System 3 and 4 Pair, Features and Specification", Molex, www.molex.com/link/Impact.html, 2008, 5 pages.
"4.0 UHD Connector Differential Signal Crosstalk, Reflections", 1998, p. 8-9.
"AMP Z-Dok and Z-Dok and Connectors", Tyco Electronics/AMP, Application Specification #114-13068, Aug. 30, 2005, 17 pages.
"AMP Z-Pack 2mm HM Connector, 2mm Centerline, Eight-Row, Right-Angle Applications", Electrical Performance Report, EPR 889065, Issued Sep. 1998, 59 pages.
"AMP Z-Pack 2mm HM Interconnection System", 1992/994, AMP Incorporated, 6 pages.
"AMP Z-Pack HM-Zd Performance at Gigabit Speeds", Tyco Electronics, Report #20GC014, Rev.B., May 4, 2001, 32 pages.
"B.? Bandwidth and Rise Time Budgets, Module 1-8 Fiber Optic Telecommunications (E-XVI-2a)", http:--cord.org-step_online-st1-8-st18exvi2a.htm, 2006, 1-3.
"Backplane Connectors", http://www.amphenol-tcs.com/products/connectors/backplane/index.html, Amphenol TCS (ATCS), Jun. 19, 2008, 1-3.
"Champ Z-Dok Connector System", Tyco Electronics, Jan. 2002, 3 pages.
"Daughtercard Hole Pattern: Signal Modules (10 & 25 positions) Connector Assembly", Customer No. C-163-5101-500, Teradyne Connection Systems, Inc., 2001, 1 page.
"FCI's Airmax VS Connector System Honored at DesignCon 2005", http:--www.heilind.com-products-fci-airmax-vs-design.asp, Heilind Electronics, Inc., 2005, 1 page.
"Framatome Connector Specification", May 10, 1999, 1 page.
"GbXI-Trac Backplane Connector System", www.molex.com/cgi-bin, Molex, 2007, 1-3.
"Gig-Array Connector System, Board to Board Connectors", 2005, 4 pages.
"Gig-Array High Speed Mezzanine Connectors 15-40 mm Board to Board", FCI Corporation, Jun. 5, 2006, 1 page.
"HDM Separable Interface Detail", Molex, Feb. 17, 1993, 3 pages.
"HDM Stacker Signal Integrity", http://www.teradyne.com/prods/tcs/products/connectors/mezzanine/hdm_stacker/sidnintegrity.html, Amphenol TCS (ATCS), Feb. 2, 2006, 3 pages.
"HDM, HDM Plus Connectors", http:--www.teradyne.com-prods-tcs-products-connectors-backplane-hdm-index.html, Amphenol TCS, 2006, 1 page.
"HDM/HDM Plus, 2mm, Backplane Interconnection System", Teradyne Connection Systems, 1993, 22 pages.
"High Definition Multimedia Interface (HDMI)", www.molex.com, Molex, Jun. 19, 2008, 2 pages.
"High Speed Backplane Interconnect Solutions", Tyco Electronics, 2007, 6 pages.
"High Speed Characterization Report, SEAM-30-02.0-S-10-2", www.samtec.com, SAMTEC, 2005, 55 pages.
"Honda High-Speed Backplane Connector NSP Series", Honda Connectors, Feb. 7, 2003, 25 pages.
"Impact 3 Pair 10 Column Signal Module", Tyco Electronics, Mar. 25, 2008, 1 page.
"Impact Connector Offered by Tyco Electronic, High Speed Backplane Connector System", Tyco Electronics, Apr. 15, 2008, 12 pages.
"Impact, 3 Pair Header Unguided Open Assembly", Tyco Electronics, Apr. 11, 2008, 1 page.
"Lucent Technologies' Bell Labs and FCI Demonstrate 25gb-S Data Transmission Over Electrical Backplane Connectors", http:--www.lucent.com-press-0205-050201.bla.html, Lucent Tech Bell Labs, Feb. 1, 2005,1-4.
"Metral 1000 Series, 5 Row Receptacle, Right Angle, Press Fit, PCB Mounted Receptacle Assembly", FCI 2001, 1 page.
"Metral 2mm High-Speed Connectors, 1000, 2000, 3000 Series, Electrical Performance Data for Differential Applications", FCI Framatome Group, 2 pages.
"Metral Speed & Density Extensions", FCI, Jun. 3, 1999, 1-25.
"Mezzanine High Speed High-Density Connectors Gig-Array and Meg-Array Electrical Performance Data", FCI Corporation, 10 pages.
"Micro Electronic Interconnects", Alphametals, 1990, 4 pages.
"MILLIPACS Connector, Type A Specification", Dec. 14, 2004,1 page.
"NSP Series, Backplane High-Speed Data Transmission Cable Connectors", http:--www.honda-connectors.co.jp, Honda Connectors, 2006, 6 pages, English Translation attached.
"Open Pin Field Array Seaf Series", www.samtec.com, SAMTEC, 2005, 1 page.
"Overview for High Density Backplane Connector (Z-Pack TinMan)", Tyco Electronics, 2008, 1 page.
"Overview for High Density Backplane Connectors (Impact) Offered by Tyco Elecctronics", www.tycoelectronics.com/catalog, Tyco Electronics, 2007, 1-2.
"Overview: Backplane Products", http:--www.molex.com-cgi-bin-by-molex-super_family-super_family.jsp?BV_SessionID=@, Molex, 2008, 1-3.
"PCB-Mounted Receptacle Assemblies, 2.00 mm (0.079 In) Centerlines, Right-Angle Solder-to-Board Signal Receptacle", Metral, Berg Electronics, 2 pages.
"Product Datasheets, 10 Bgit/s XENPAK 850 nm Transponder (TRP10GVP2045)", MergeOptics GmbH, 2005, 13 pages.
"Product Datasheets, Welcome to Xenpak.org.", http://www.xenpak.org., 2001, 1 page.
"Two-Piece, High-Speed Connectors", www.tycoelectronics.com/catalog, Tyco Electronics, 2007, 1-3.
"Tyco Unveils Z-Pack TinMan Orthogonal Connector System", http://www.epn-online.com/pade/new59327/tyco-unveils-z-pack-orthogonal-conn, Oct. 13, 2009, 4 pages.
"Ventura High Performance, Highest Density Available", http://www.amphenol-tcs.com/products/connectors/backplane/ventura/index.html, Amphenol TCS (ATCS), Jun. 19, 2008, 1-2.
"VHDM Connector", http://www.teradyne.com/prods/tcs/products/connectors/backplane/vhdm/index.html, Amphenol TCS (ATCS), Jan. 31, 2006, 2 pages.
"VHDM Daughterboard Connectors Feature Press-Fit Terminations and a Non-Stubbing Separable Interface", Teradyne, Inc. Connections Sys Div, Oct. 8, 1997, 46 pages.
"VHDM High-Speed Differential (VHDM HSD)", http://www.teradyne.com/prods/bps/vhdm/hsd.html, Teradyne, Jan. 24, 2000, 6 pages.
"VHDM L-Series Connector", http://www.teradyne.com/prods/tcs/products/connectors/backplane/vhdm_1-series/index.html, Amphenol TCS(ATCS), 2006, 4 pages.
"XCede® Connector", http://www.amphenol-tcs.com/products/connectors/backplane/xcede/index.html, Amphenol TCS (ATCS), Jun. 19, 2008, 1-5.
"Z-Dok and Connector", http://2dok.tyco.electronics.com, Tyco Electronics, May 23, 2003, 1-15.
"Z-Pack Slim UHD", http:/ww.zpackuhd.com, Tyco Electronics, 2007, 8 pages.
"Z-Pack TinMan High Speed Orthogonal Connector Product Feature Selector", Tyco Electronics, 2009, 2 pages.
"Z-Pack TinMan Product Portfolio Expanded to Include 6-Pair Module", Tyco Electronics, Jun. 19, 2008, 1 page.
Ahn et al., "A Design of the Low-Pass Filter Using the Novel Microstrip Defected Ground Structure", IEEE Transactions on Microwave Theory and Techniques, 2001, 49(1), 86-93.

(56) References Cited

OTHER PUBLICATIONS

Berg Electronics Catalog, p. 13-96, Solder Washers, 1996, 1 page.
Chen et al., "Characteristics of Coplanar Transmission Lines on Multilayer Substrates: Modeling and Experiments", IEEE Transactions on Microwave Theory and Techniques, Jun. 1997, 45(6), 939-945.
Cheng et al., "'Terahertz-Bandwidth Characteristics of Coplanar Transmission Lines on Low Permittivity Substrates", IEEE Transactions on Microwave Theory and Techniques, 1994, 42(12), 2399-2406.
Chua et al., "'Broadband Characterisation of CPW Transition and Transmission Line Parameters for Small Reflection Up to 100 GHZ", RF and Microwave Conference, 2004, 269-271.
Derman, "Speed, Density Push Design Xomplexities", Electronic Engineering Times, May 1998, 2 pages.
European Patent Application No. 10753953.8: Extended European Search Report dated Nov. 7, 2013, 6 pages.
European Patent Application No. 12305119.5: European Search Report dated Jul. 11, 2012, 5 pages.
Finan, "Thermally Conductive Thermoplastics", LNP Engineering Plastics, Inc., Plastics Engineering 2000, www.4spe.org, 4 pages.
Fusi et al., "Differential Signal Transmission through Backplanes and Connectors", Electronic Packaging and Production, Mar. 1996, 27-31.
Goel et al., "AMP Z-Pack Interconnect System", AMP Incorporated, 1990, 9 pages.
Hettak et al., "Simultaneous Realization of Millimeter Wave Uniplanar Shunt Stubs and DC Block", IEEE MTT-S Digest, 1998, 809-812.
Hult, "FCI's Problem Solving Approach Changes Market, The FCI Electronics AirMax VS", http:--www.connecotrsupplier.com-tech_updates_FCI-Airmax_archive.htm, ConnectorSupplier.com, 2006, 1-4.
Hunsaker, "Ventura Application Design", TB-2127, Amphenol, Aug. 25, 2005, 13 pages.
IBM Technical Disclosure Bulletin, 1972, 14(8), 2 pages.
IBM Technical Disclosure Bulletin, 1977, 20(2), 2 pages.
IBM Technical Disclosure Bulletin, 1990, 32(11), 2 pages.
International Application No. PCT/US2003/014370, International Search Report dated Aug. 6, 2003, 2 pages.
International Application No. PCT/US2010/040899, International Search Report dated Jan. 25, 2011, 2 pages.
International Patent Application No. PCT/US2013/035775: International Search Report dated Jul. 18, 2013, 3 pages.
International Patent Application No. PCT/US2013/035915: International Search Report and Written Opinion dated Jul. 25, 2013, 17 pages.
International Patent Application No. PCT/US2013/049995: International Search Report dated Oct. 28, 2013, 18 pages.
Kazmierowicz, "Profiling Your Solder Reflow Oven in Three Passes or Less", KIC Oven Profiling, Surface Mount Technology, 1990, 2 pages.
Kazmierowicz, "The Science Behind Conveyor Oven Thermal Profiling", KIC Oven Profiling, Surface Mount Technology,1990, 9 pages.
Lee et al., "Characteristic of the Coplanar Waveguide to Microstrip Right-Angled Transition", Department of Electronics Engineering, 1998, 3 pages.
Leung et al., "Low-Loss Coplanar Waveguides Interconnects on Low-Resistivity Silicon Substrate", IEEE Transactions on Components and Packaging Technologies, 2004, 27(3), 507-512.
Lim et al., "A Spiral-Shaped Defected Ground Structure for Coplanar Waveguide", IEEE Microwave and Wireless Components Letters, 2002, 12(9), 330-332.
Machac et al., "Space Leakage of Power from Uniplanar Transmission Lines", Czech Technical University, 565-568.
Mao et al., "Characterization of Coplanar Waveguide Open End Capacitance-Theory and Experiment", IEEE Transactions on Microwave Theory and Techniques, 1994, 42(6), 1016-1024.
Mottonen et al., "Novel Wide-Band Coplanar Waveguide-to-Rectangular Waveguide Transition", IEEE Transactions on Microwave Theory and Techniques, 2004, 52(8), 1836-1842.
Nadolny et al., "Optimizing Connector Selection for Gigabit Signal Speeds", http:--www.ecnmag.com-article-CA45245, ECN, Sep. 1, 2000, 6 pages.
Ogando, "And now—An Injection-Molded Heat Exchanger", Sure, plastics are thermal insulators, but additive packages allow them to conduct heat instead, Global Design News, Nov. 1, 2000, 4 pages.
Power TwinBlade I/O Cable Connector RA-North-South, No. GS-20_072, Aug. 6, 2007, 11 pages.
Research Disclosure, Kenneth Mason Publications Ltd., England, Aug. 1990, No. 316, 1 page.
Research Disclosure, Kenneth Mason Publications Ltd., England, Oct. 1992, No. 342, 1 page.
Sherman, "Plastics that Conduct Heat", Plastics Technology Online, Jun. 2001, http://www.plasticstechnology.com, 4 pages.
Siemens, "SpeedPac: A New Concept for the Next Generation of Transmission Speed," Backplane Interconnection, Jan. 1996.
Soliman. et al., "Multimodel Characterization ofPlanar Microwave Structures", IEEE Transactions on Microwave Theory and Techniques, 2004, 52(1), 175-182.
Son et al., "'Picosecond Pulse Propagation on Coplanar Striplines Fabricated on Lossy Semiconductor Substrates: Modeling and Experiments", IEEE Transactions on Microwave Theory and Techniques, 1993, 41(9), 1574-1580.
Straus, "Shielded In-Line Electrical Multiconnector", IBM Technical Disclosure Bulletin, Aug. 3, 1967, 10(3), 3 pages.
Suh et al., "Coplanar Strip line Resonators Modeling and Applications to Filters", IEEE Transactions on Microwave Theory and Techniques, 2002, 50(5), 1289-1296.
Tzuang et al., "Leaky Mode Perspective on Printed Antenna", Proc. Natl. Sci. Counc. ROC(A), 1999, 23(4), 544-549.
Weller et al., "High Performance Microshield Line Components", IEEE Transactions on Microwave Theory and Techniques, 1995, 43(3), 534-543.
Williams et al., "Accurate Transmission Line Characterization", IEEE Microwave and Guided Wave Letters, 1993, 3(8), 247-249.
Wu et al., "'Full-Wave Characterization of the Mode Conversion in a Coplanar Waveguide Right-Angled Bend", IEEE Transactions on Microwave Theory and Techniques, 1995, 43(11), 2532-2538.
Ya et al., "Microstrip and Slotline Two-Pole Microwave Filters with Additional Transmission Zeros", Int. Crimean Conference, Microwave & Telecommunication Technology, 2004, 405-407 (English Abstract provided).

* cited by examiner

ELECTRICAL CONNECTOR HAVING RIBBED GROUND PLATE

CROSS-REFERENCE TO RELATED APPLICATIONS

This is a continuation application of U.S. patent application Ser. No. 13/755,628 filed Jan. 31, 2013, which is a continuation of U.S. patent application Ser. No. 12/722,797 filed Mar. 12, 2010, which claims priority to U.S. patent application Ser. No. 61/161,687 filed Mar. 19, 2009, the disclosure of each of which is hereby incorporated by reference as if set forth in its entirety herein.

BACKGROUND

Electrical connectors provide signal connections between electronic devices using electrically-conductive contacts. It is sometimes desirable to increase data transfer through an existing connector without changing the physical dimensions (height, width, depth, mating interface, and mounting interface) of the connector. However, it is difficult to change one aspect of an electrical connector without unintentionally changing another aspect. For example, metallic crosstalk shields can be added to an electrical connector to reduce crosstalk, but the addition of shields generally lowers the impedance. At lower data transmission speeds, such at 1 to 1.25 Gigabits/sec, impedance matching does not substantially affect performance. However, as data transmission speeds increase to 10 Gigabits/sec through 40 Gigabits/sec and any discrete point therebetween, skew and impedance mismatches become problematic. Therefore, while crosstalk can be lowered by adding a metallic crosstalk shield to an existing electrical connector, other problems with signal integrity can be created.

What is therefore desired is an electrical connector having a shield that avoids the shortcomings of conventional shields.

SUMMARY

In accordance with one aspect, an electrical connector includes a dielectric housing, a plurality of electrical signal contacts carried by the dielectric housing, and a ground plate carried by the dielectric housing. The electrical signal contacts are arranged along a first plane, wherein the signal contacts define signal pairs such that a respective gap is disposed between adjacent signal pairs. The ground plate includes a ground plate body oriented in a second plane that is substantially parallel to the first plane and offset from the first plane. The ground plate body defines first and second opposed surfaces. The ground plate includes at least one stamped or embossed rib that defines first and second opposed surfaces, wherein the first surface of the rib projects from the first surface of the ground plate body in a direction toward the gap, and the second surface is recessed into the second surface of the ground plate body. The at least one stamped or embossed rib takes the place of or electrically functions as a ground contact between two differential signal pairs positioned edge-to-edge with respect to one another or broadside-to-broadside with respect to one another.

BRIEF DESCRIPTION OF THE DRAWINGS

The foregoing summary, as well as the following detailed description of a preferred embodiment of the application, will be better understood when read in conjunction with the appended drawings. For the purposes of illustrating the flexible anchoring keel and related instruments of the present application, there is shown in the drawings a preferred embodiment. It should be understood, however, that the application is not limited to the precise arrangements and instrumentalities shown. In the drawings.

DETAILED DESCRIPTION

Figure 1:
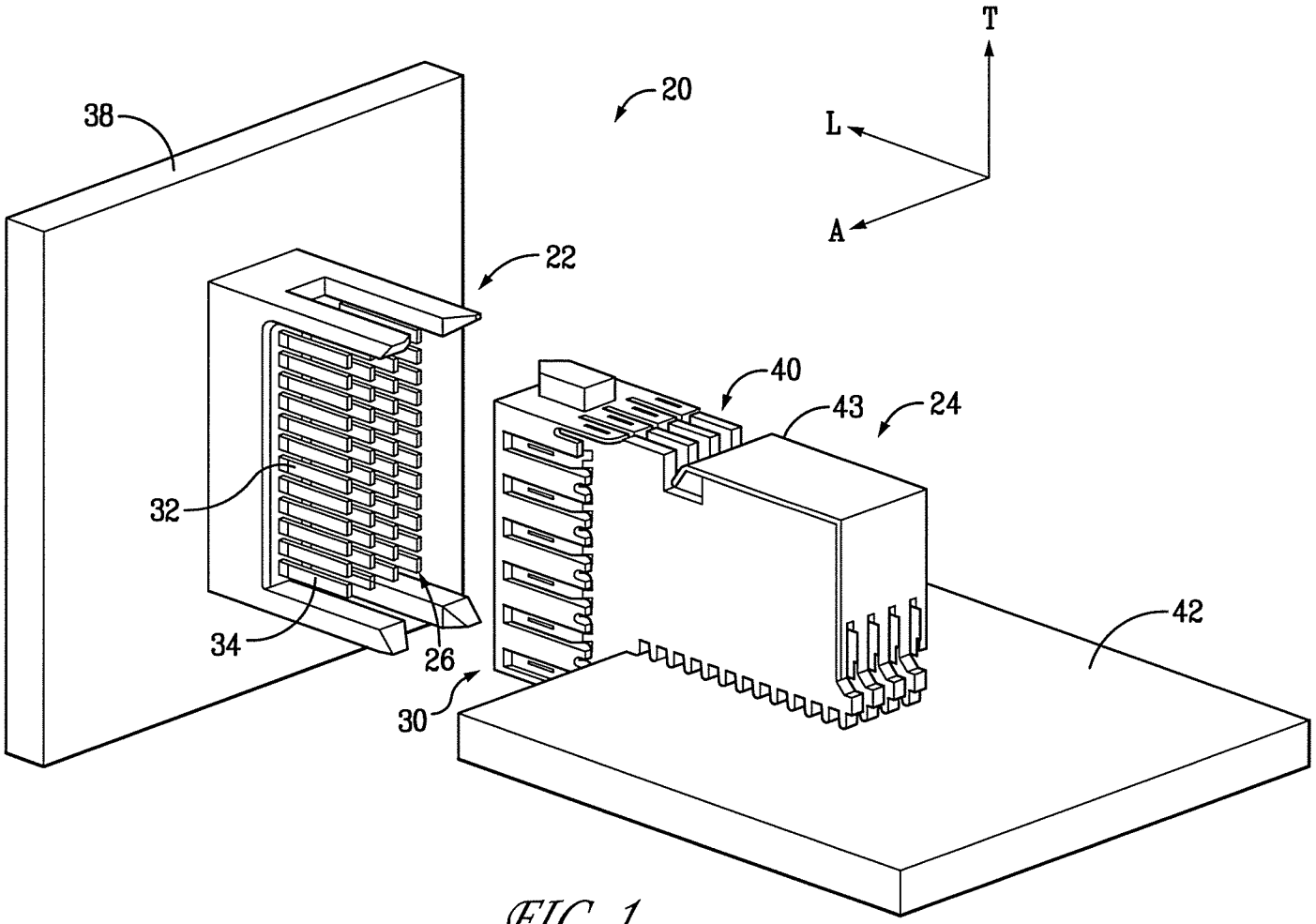
FIG. 1 is a perspective view of an electrical connector assembly including a vertical header connector and a right-angle receptacle connector mounted onto respective substrates, and configured to be mated with each other.
Figure 2A:
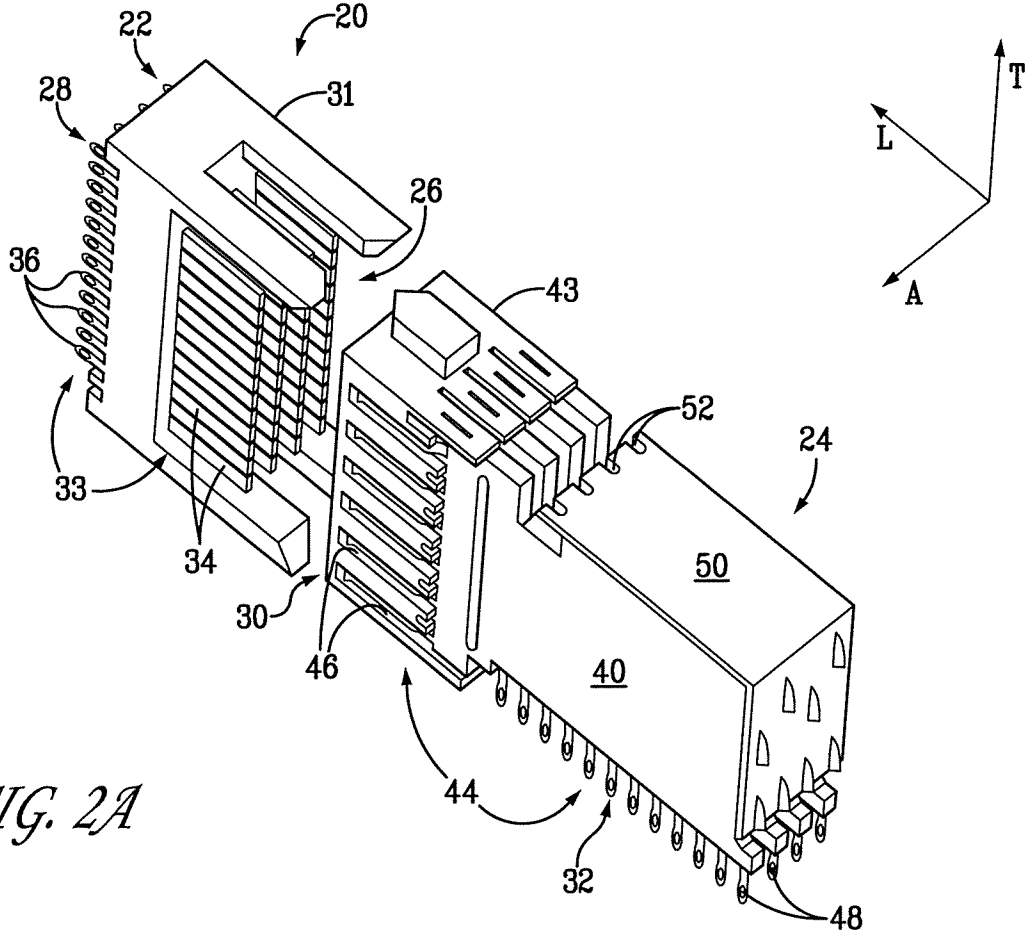
FIG. 2A is a perspective view of the electrical connector assembly similar to FIG. 1, but without the substrates.
Figure 2B:
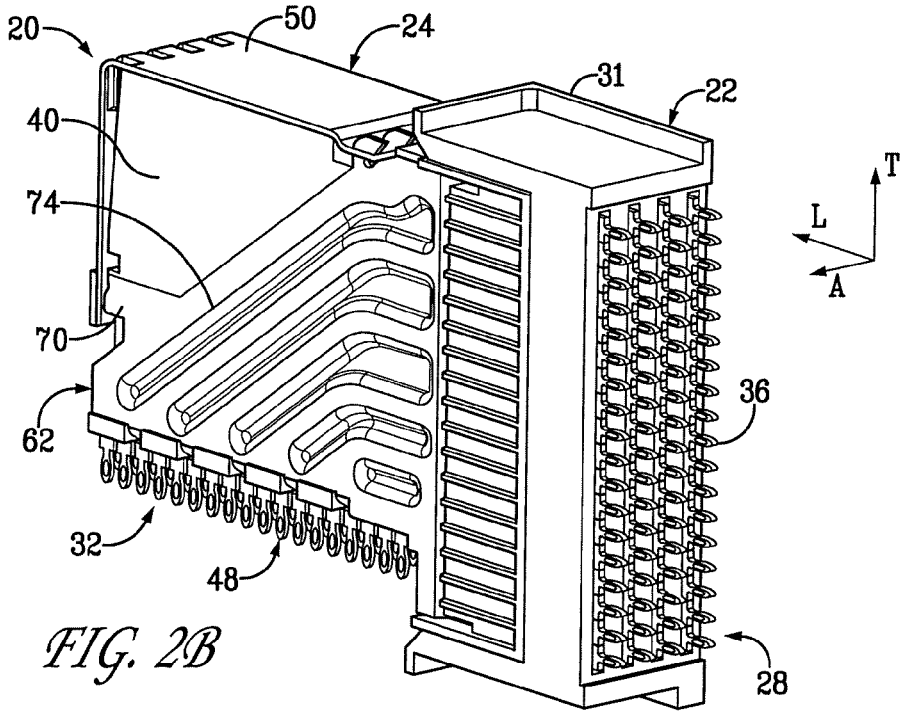
FIG. 2B is another perspective view of the electrical connector assembly as illustrated in FIG. 2A, but showing the electrical connectors in a mated configuration.

Referring initially to FIGS. 1-2B, an electrical connector assembly 20 includes a first electrical connector 22 and a second electrical connector 24 configured to mate with each other so as to establish an electrical connection between complementary substrates 38 and 42. As shown, the first electrical connector 22 can be a vertical connector defining a mating interface 26 and a mounting interface 28 that extends substantially parallel to the mating interface 26. The second electrical connector 24 can be a right-angle connector defining a mating interface 30 and a mounting interface 32 that extends substantially perpendicular to the mating interface 30.

The first electrical connector 22 includes a housing 31 that carries a plurality of electrical contacts 33. The electrical contacts 33 may be insert molded prior to attachment to the housing 31 or stitched into the housing 31. The electrical contacts 33 define respective mating ends 34 that extend along the mating interface 26, and mounting ends 36 that extend along the mounting interface 28. Each of the mating ends 34 can define a respective first broadside and a respective second broadside opposite the first broadside so as to define header mating ends. Thus, the first electrical connector 22 can be referred to as a header connector as illustrated. The mounting ends 36 may be press-fit tails, surface mount tails, or fusible elements such as solder balls, which are configured to electrically connect to a complementary electrical component such as a substrate 38 which is illustrated as a printed circuit board. The substrate 38 can be provided as a backplane, midplane, daughtercard, or the like.

Because the mating interface 26 is substantially parallel to the mounting interface 28, the first electrical connector 22 can be provided as a vertical connector, though it should be appreciated that the first electrical connector can be provided in any desired configuration so as to electrically connect the substrate 38 to the second electrical connector 24. For instance, the first electrical connector 22 can be provided as a header connector or a receptacle connector, and can be arranged as a vertical or mezzanine connector or a right-angle connector as desired.

With continuing reference to FIGS. 1-2B, the second electrical connector 24 includes a plurality of insert molded leadframe assemblies (IMLAs) 40 that are carried by an electrical connector housing 43. Each IMLA 40 carries a plurality of electrical contacts, such as right angle electrical contacts 44. Any suitable dielectric material, such as air or plastic, may be used to isolate the right angle electrical contacts 44 from one another. The right angle electrical contacts 44 define a respective receptacle mating ends 46 that extend along the mating interface 30, and a mounting ends 48 that extend along the mounting interface 32. Each mating end 46 extends horizontally forward along a longitudinal or first direction L, and the IMLAs 40 are arranged adjacent each other along a lateral or second direction A that is substantially perpendicular to the longitudinal direction L.

Each mounting end 48 extends vertically down along a transverse or third direction T that is perpendicular to both the lateral direction A and the longitudinal direction L. Thus, as illustrated, the longitudinal direction L and the lateral direction A extend horizontally as illustrated, and the transverse direction T extends vertically, though it should be appreciated that these directions may change depending, for instance, on the orientation of the electrical connector 24 during use. Unless otherwise specified herein, the terms "lateral," "longitudinal," and "transverse" as used to describe the orthogonal directional components of various components and do not limit to specific differential signal pair configurations. The terms "inboard" and "inner," and "outboard" and "outer" with respect to a specified directional component are used herein with respect to a given apparatus to refer to directions along the directional component toward and away from the center apparatus, respectively.

The receptacle mounting ends 48 may be constructed similar to the header mounting ends 36, and thus may include press-fit tails, surface mount tails, or fusible elements such as solder balls, which are configured to electrically connect to a complementary electrical component such as a substrate 42 which is illustrated as a printed circuit board. The substrate 42 can be provided as a backplane, midplane, daughtercard, or the like. The receptacle mating ends 46 are configured to electrically connect to the respective header mating ends 34 of the first electrical connector 22 when the respective mating interfaces 26 and 30 are engaged.

The right angle electrical contacts 44 may have a material thickness of about 0.1 mm to 0.5 mm and a contact height of about 0.1 mm to 0.9 mm. The contact height may vary over the length of the right angle electrical contacts 44. The second electrical connector 24 also may include an IMLA organizer 50 that may be electrically insulated or electrically conductive. An electrically conductive IMLA organizer 50 that retains the IMLAs 40 may be electrically connected to electrically conductive portions of the IMLAs 40 via slits 52 defined in the IMLA organizer 50 or any other suitable connection.

Because the mating interface 30 is substantially perpendicular to the mounting interface 32, the second electrical connector 24 can be provided as a right-angle connector, though it should be appreciated that the first electrical connector can be provided in any desired configuration so as to electrically connect the substrate 42 to the first electrical connector 22. For instance, the second electrical connector 24 can be provided as a receptacle connector or a header connector, and can be arranged as a vertical or mezzanine connector or a right-angle connector as desired. When the connectors 22 and 24 are mounted onto their respective substrates 38 and 42 and electrically connected to each other, the substrates are placed in electrical communication.

Figure 3A:
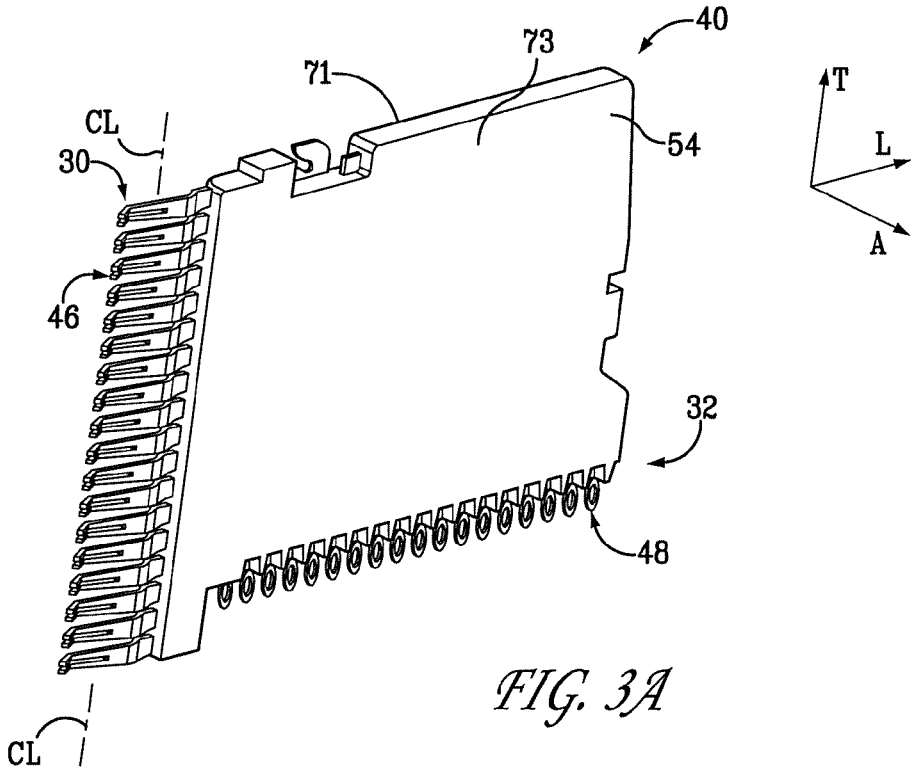
FIG. 3A is a perspective view of one of the IMLAs illustrated in FIGS. 2A-B.
Figure 3B:
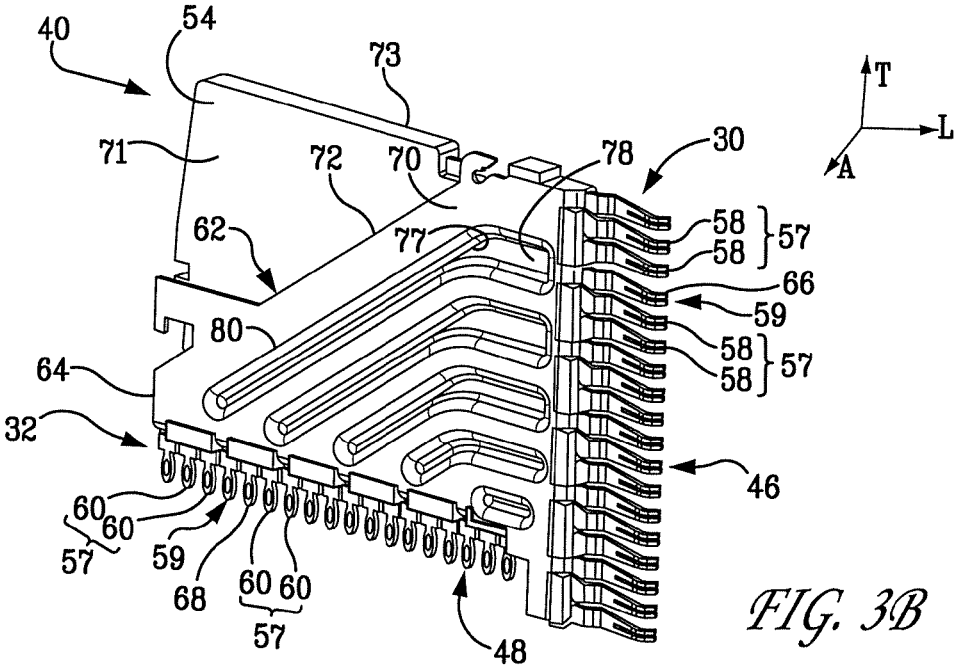
FIG. 3B is another perspective view of the IMLA illustrated in FIG. 3A showing the ground plate.
Figure 3C:
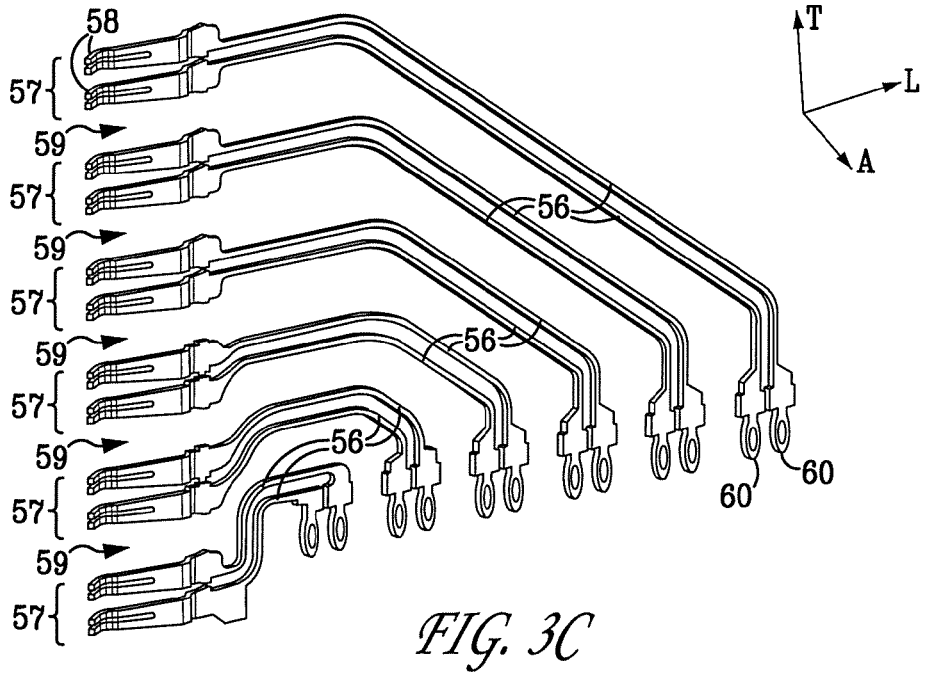
FIG. 3C is a perspective view of the electrical signal contacts of the IMLA illustrated in FIG. 3A, showing the electrical signal contacts arranged as supported by the leadframe housing.

Referring now also to FIGS. 3A-C, Each IMLA 40 includes a leadframe housing 54 which can be provided as a dielectric housing that defines laterally opposed outer surfaces 71 and 73. The leadframe housing can be made of any suitable dielectric material such as plastic, and carries a plurality of electrical signal contacts 56 form right-angle contacts which can be overmolded by the housing 54, or can alternatively can be stitched or otherwise attached in the housing 54. Each signal contact 56 includes a mating end 58 and a mounting end 60. The mating ends 58 of the signal contacts 56 are aligned along the transverse direction T, and the mounting ends 60 of the signal contacts 56 are aligned along the longitudinal direction L. The signal contacts 56 are arranged in pairs 57 (see also FIGS. 6B-C), which can be differential signal pairs. Alternatively, the signal contacts 56 can be provided as single-ended signal contacts. One or more up to all of adjacent pairs 57 of signal contacts 56 are separated by a gap 59.

Figure 4A:
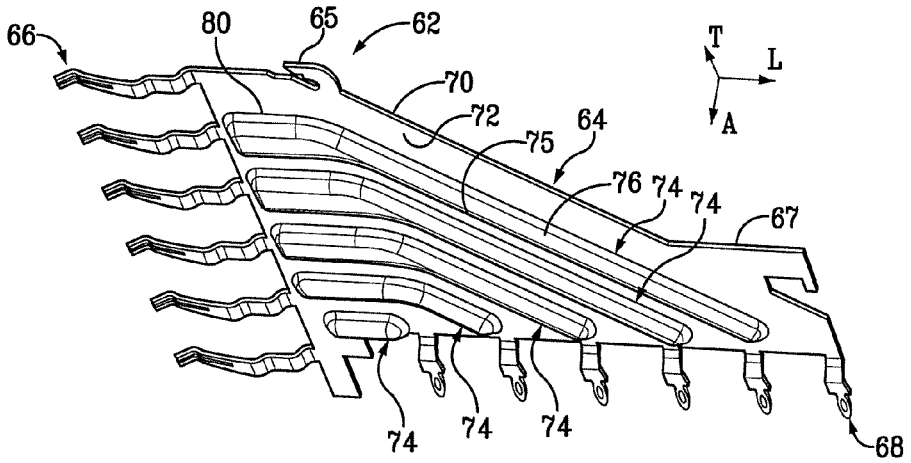
FIG. 4A is a perspective view of the ground plate illustrated in FIG. 3B.
Figure 4B:
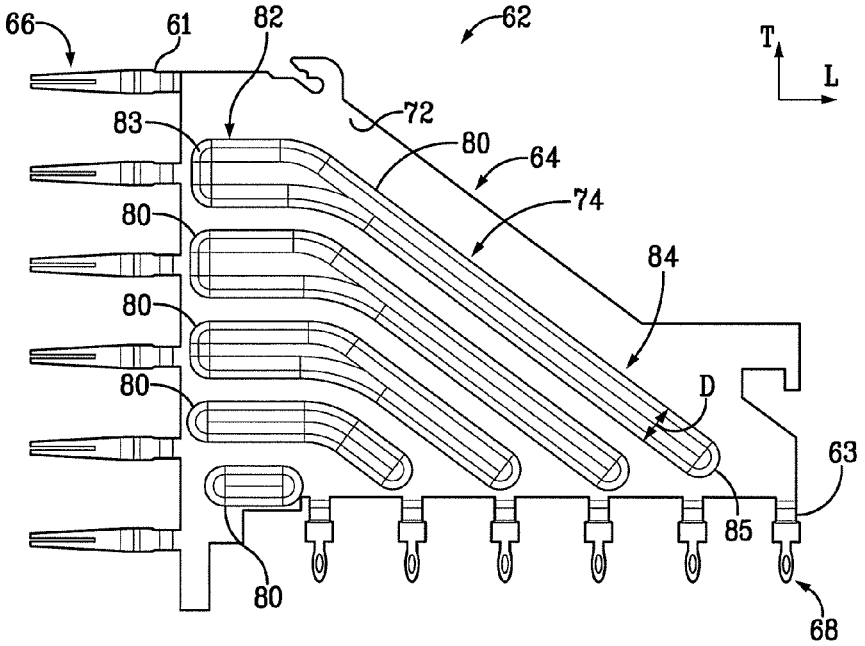
FIG. 4B is a side elevation view of the ground plate illustrated in FIG. 4A.
Figure 5A:
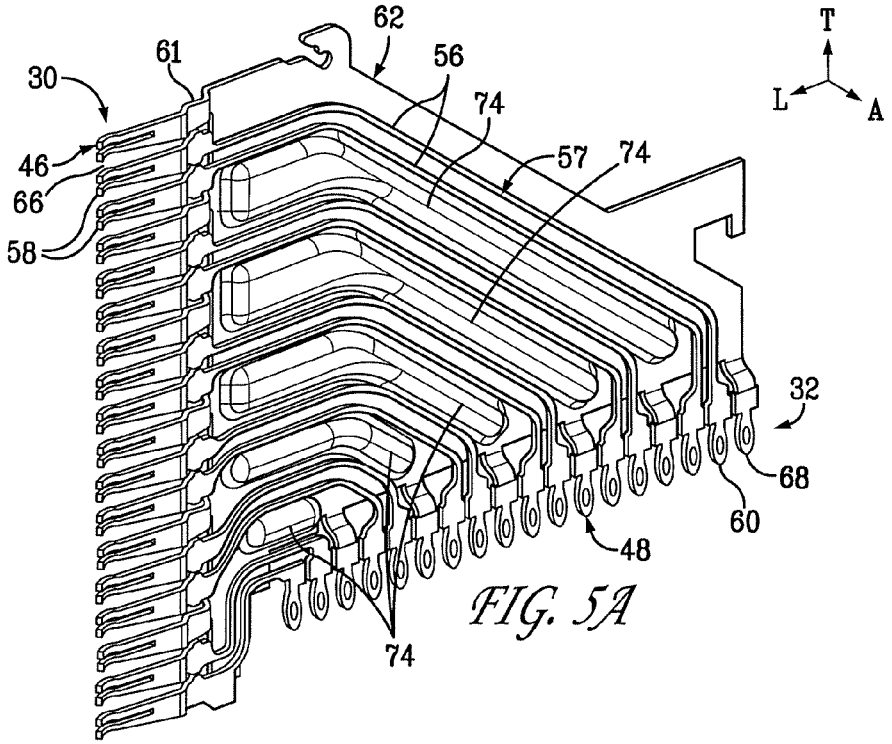
FIG. 5A is a perspective view of the IMLA as illustrated in FIG. 3A but with the leadframe housing removed.
Figure 5B:
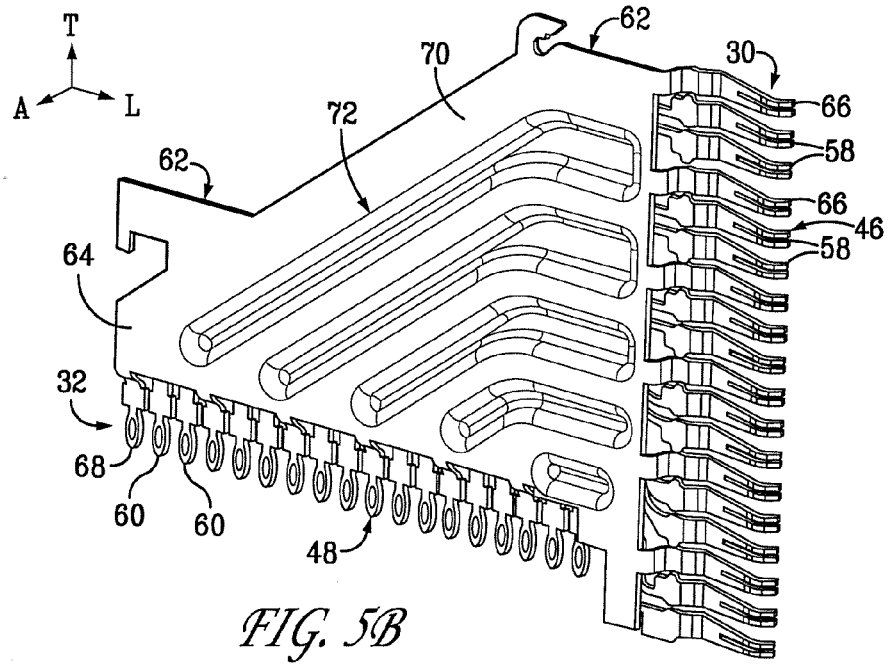
FIG. 5B is a perspective view of the IMLA as illustrated in FIG. 3B but with the leadframe housing removed.

Each IMLA 40 further includes a ground plate 62 that is carried by the leadframe housing 54. The ground plate 62 can be formed from any suitable electrically conductive material, such as a metal, and includes a body 64, a plurality of mating ends 66 extending forward from the body 64, and a plurality of mounting ends 68 extending down from the body. The mating ends 66 and mounting ends 68 can be constructed as described above with respect to the mating ends 58 and 60 of the electrical signal contacts 56. The ground plate 62 can be discretely attached to the housing 54 or overmolded by the housing 54. Referring now also to FIGS. 4A-B, the body 64 of the ground plate 62 defines an inner or first surface 72 and an outer or second surface 70 that is laterally opposed with respect to the inner surface 72. The outer surface 70 can be flush with, can protrude past, or can be inwardly recessed with respect to the corresponding outer surface 71 of the leadframe housing 54. Accordingly, the dimensions of the electrical connector 24 can remain unchanged with respect to electrical connectors whose IMLAs carry discrete ground contacts, for instance as described in U.S. Pat. No. 7,497,736, the disclosure of which is hereby incorporated by reference as if set forth in its entirety herein. The inner surface 72 faces the electrical signal contacts 56 of the IMLA 40. The ground plate 62 can further include at least one engagement member configured to attach to the organizer, such as upper or first hook 65 and a rear or second hook 67.

The ground plate 62 can be electrically conductive, and thus configured to reflect electromagnetic energy produced by the signal contacts 56 during use, though it should be appreciated that the ground plate 62 could alternatively be configured to absorb electromagnetic energy. For instance the ground plate 62 can be made from one or more ECCOSORB® absorber products, commercially available fro Emerson & Cuming, located in Randolph, Mass. The ground plate 62 can alternatively be made from one or more SRC Polylron® absorber products, commercially available from SRC Cables, Inc, located in Santa Rosa, Calif. Furthermore, the ground plates 62 are disposed between the signal contacts 56 of adjacent IMLAs, the ground plates 62 can provide a shield that reduces cross-talk between signal the signal contacts 56 of adjacent IMLAs 40.

The mating ends 66 of the ground plate 62 define ground mating ends, while the mounting ends 68 of the ground plate 62 define ground mounting ends. The mating ends 66 are aligned along the transverse direction T, and are further aligned with the mating ends 58 along the transverse direction T. The mounting ends 68 are aligned along the longitudinal direction L, and are aligned with the mounting ends 60 along the longitudinal direction L. The mating ends 66 are positioned adjacent and/or between pairs 57 of mating ends 58, and the mounting ends 68 are positioned adjacent and/or between pairs of mounting ends 60. Thus, the mating ends 46 of the electrical connector 24 include both the mating ends 58 and the mating ends 66, and the mounting ends 48 of the electrical connector 24 include both the mounting ends 60 and the mounting ends 68.

In accordance with the illustrated embodiment, the mating ends 66 of the ground plate 62 are disposed in the gap 59 that extends between adjacent pairs 57 of mating ends 58, such that the mating ends 46, which includes mating ends 58 and 66, are equidistantly spaced along the mating interface 30 of the electrical connector 24. Likewise, the mounting ends 68 of the ground plate 62 are disposed in the gap 59 that extends between adjacent pairs of mounting ends 60, such that the mounting ends 48, which includes the mounting ends 60 and 68, are equidistantly spaced along the mounting interface 32 of the electrical connector 24.

The pairs 57 of electrical signal contacts 56 may be differential signal pairs, or the signal contacts 56 can be provided as single-ended contacts. The signal contacts 56 are positioned edge-to-edge along a common centerline CL. Six differential signal pairs 57 are illustrated, however the connector 24 can include any number of differential signal pairs extending along the centerline CL, such as two, three, four, five, six, or more.

Referring now to FIGS. 4A-5B, the ground plate 62 includes at least one rib 74, such as a plurality of ribs 74 supported by the plate body 64. In accordance with the illustrated embodiment, each rib 74 is stamped or embossed into the body 64, and is thus integral with the body 64. Thus, the ribs 74 can further be referred to as embossments. As illustrated, each rib 74 defines a first surface 75 that defines a projection 76 extending laterally inwardly (e.g., into the IMLA 40) from the inner surface 72, and an opposed second surface 77 that defines a corresponding divot 78 or recessed surface extending into the outer surface 70 of the ground plate body 64. Otherwise stated, the body 64 includes a plurality of projections 76 projecting laterally from the inner surface, and further includes a plurality of divots 78, corresponding to the plurality of projections 76, recessed in the outer surface 70. The ribs 74 define respective enclosed outer perimeters 80 that are spaced from each other along the ground plate body 64. Thus, the ribs 74 are fully contained in the plate body 64.

The ribs 74 define a front or first portion 82 disposed proximate to the mating ends 66, and a rear or second portion 84 that is disposed proximate to the mounting ends 68. The front and rear portions 82 and 84 define a respective front or first terminal end 83, and a rear or second terminal end 85. The ribs 74 thus define a length extending between the first end second terminal ends 83 and 85. As illustrated, the ribs 74 can have different lengths along the ground plate body 64. For instance, those ribs 74 disposed at an upper or first end of the ground plate body 64 are longer than the ribs 74 that are disposed at a lower or second end of the ground plate body 64. In accordance with the illustrated embodiment, the length of each ribs 74 decreases along a direction from the upper or first end to the lower or second end of the ground plate body 64.

The ribs 74 can extend along a direction that includes one or more of a horizontal or longitudinal direction, a vertical or transverse direction, and an angled direction having both longitudinal and transverse directional components. For instance, as illustrated, the front portions 82 of some of the ribs 74 extend along a longitudinal rearward or direction from a location proximate to the mating ends 66 to the rear portion 84. The rear portion 84 extends along a second direction that is laterally rearward and transversely down from the front portion 82 to a location proximate to the mounting ends 68. The rear portion 84 extends at an angle between 90° and 180° with respect to the front portion 82. It should be appreciated that one or more of the ribs 74, for instance the bottommost rib 74 shown in FIG. 4B, extends only longitudinally. It should be further appreciated that one or more of the ribs 74 can further extend along a third transverse direction, for instance at a location proximate to the mounting ends 68.

Referring now to FIGS. 4A-6C, the electrical signal contacts 56 are aligned or arranged in a first transverse-longitudinal plane T-L1 that includes the common centerline CL, and the ground plate body 64 is oriented in a second transverse-longitudinal ground plane T-L2 that extends substantially parallel to the first plane T-L1, and is laterally outwardly offset or spaced from the first plane T-L1. The projection 76 of each rib 74 extends laterally inward from the inner surface 72 of the ground plate body 64 toward the first plane T-L1. The projections 76 can extend laterally from the inner surface 72 a distance sufficient such that a portion of each projections 76 extends into the first plane T-L1 and is thus co-planar with the signal contacts 56 (or a portion of the signal contacts 56), but less than the thickness of the leadframe housing 54 such that the projections 76 are recessed with respect to the outer surface 73 (see FIG. 3B). The projections 76 are aligned with the gaps 59 disposed between adjacent pairs 57 of signal contacts 56, such that the portion of each projection 76 that extends into the first plane T-L1 between adjacent pairs 57 is disposed in a corresponding one of the gaps 59.

The ground plate 62 includes a first neck 61 extending between the ground plate body 64 and each mating end 66, and a second neck 63 extending between the ground plate body 64 and each mounting end 68. In particular, each first neck 61 extends laterally inward from the second plane T-L2 toward the first plane T-L1 along a longitudinally forward direction from the ground plate body 64, such that the mating ends 66 lie in the first plane T-L1 and are thus co-planar with the mating ends 58 of the signal contacts 56. Likewise, the second neck 63 extends laterally inward from the second plane T-L2 toward the first plane T-L1 along a transversely downward direction from the ground plate body 64, such that the mounting end 68 lies in the first plane T-L1, and is thus co-planar with the mounting ends 60 of the signal contacts 56.

Each rib 74 defines a cross-sectional distance D that extends along the second plane T-L2 in a direction normal to the outer perimeter 80. The distance D can be consistent along the length of a given rib 74, as illustrated in the lowermost rib 74 shown in FIG. 4A. Alternatively, the distance D can vary along the length of a given rib between the front and rear ends 83 and 85, respectively. For instance, the distance D can be smaller at the rear portion 84 than at the front portion 82. Otherwise stated, the distance D can increase along the length of the rib 74 from the rear portion 84 to the front portion 82. Likewise, the gap 59 disposed between adjacent pairs 57 of signal contacts 56 can increase along a direction from the mounting ends 60 toward the mating ends 58 so as to accommodate the increasing cross-sectional distance D of the ribs 74.

Figure 6A:
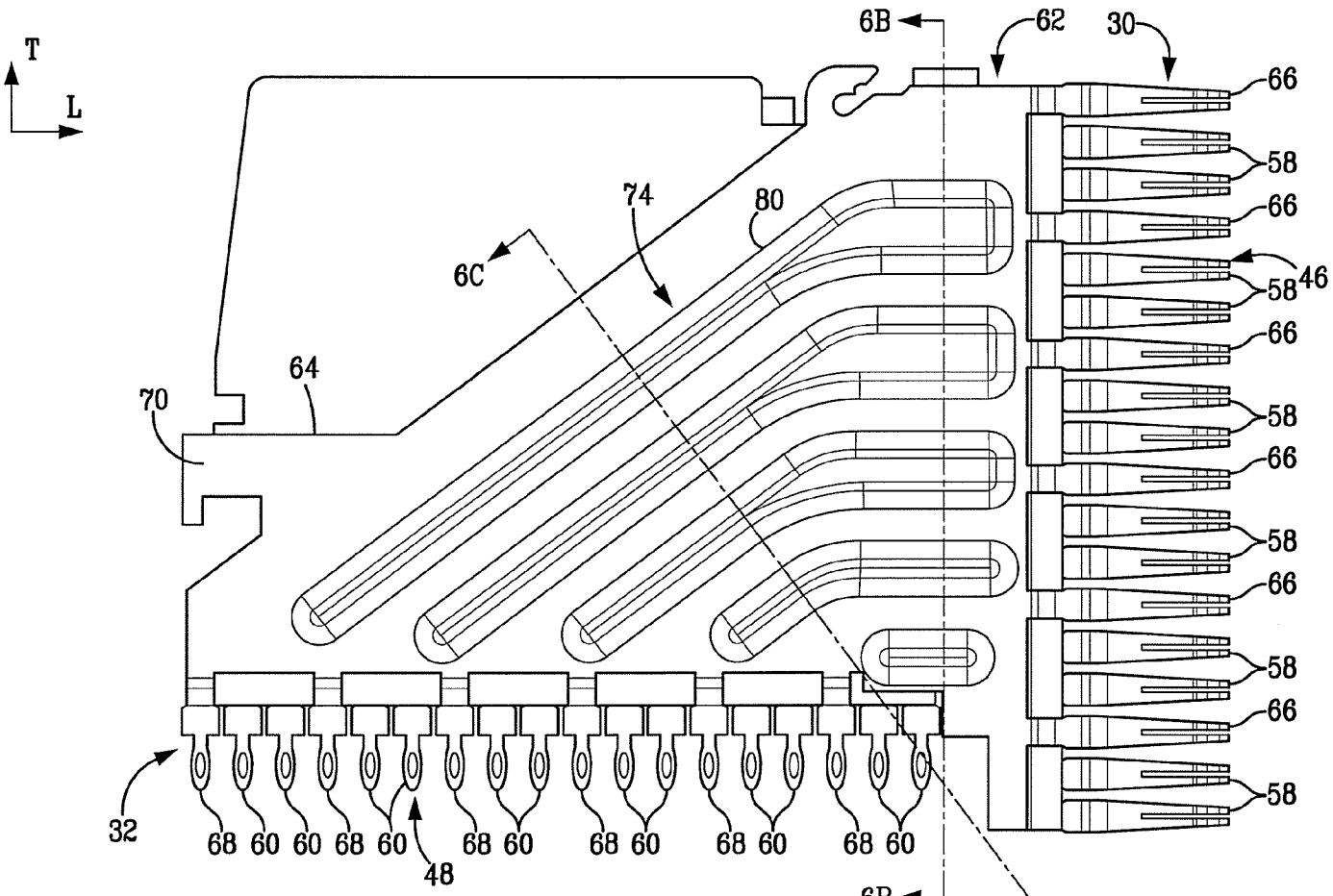
FIG. 6A is a side elevation view of the IMLA illustrated in FIG. 3B.
Figure 6B:
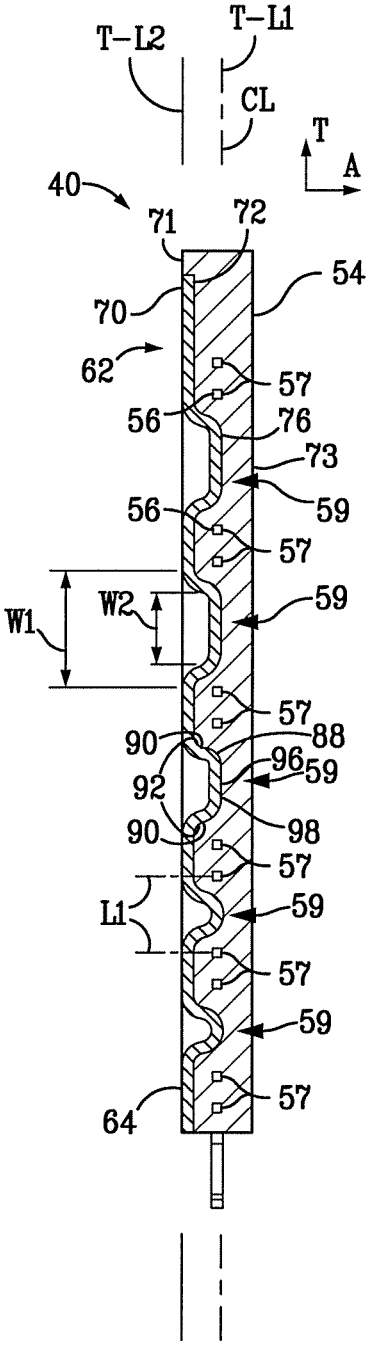
FIG. 6B is a sectional view of the IMLA illustrated in FIG. 6A, taken along line 6B-6B.
Figure 6C:
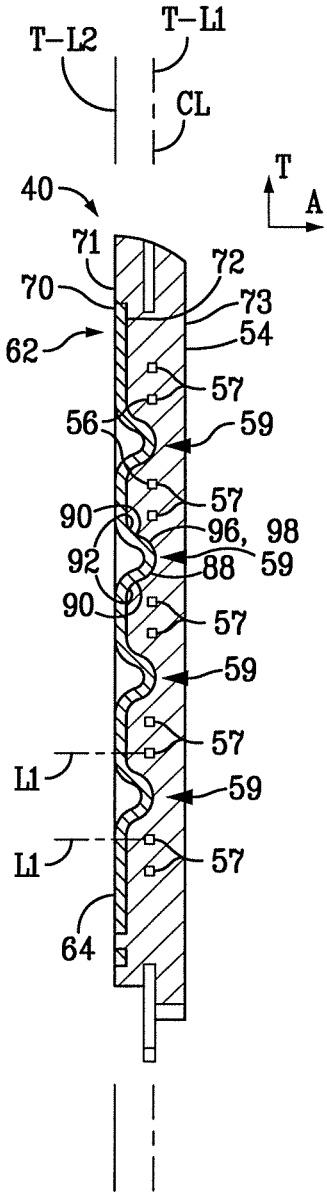
FIG. 6C is a sectional view of the IMLA illustrated in FIG. 6A, taken along line 6C-6C.

With continuing reference to FIGS. 4A-6C, and in particular to FIGS. 6B-C, each rib 74 can include at least one wall 88. The wall 88 includes opposed outer wall portions 90 that each extend laterally from the inner surface 72 at the outer perimeter 80, and can converge toward each other along their direction of extension from the inner surface 72. When the ground plate 62 is installed in the IMLA, the outer wall portions 90 extend into a corresponding one of the gaps 59 between adjacent pairs 57 of signal contacts 56. As illustrated, the outer wall portions 90 can be beveled or curved. Furthermore, the curvature of each rib 74 can vary along its length. The outer wall portions 90 define from a proximal end 92 of the rib 74, and terminate at a middle wall portion 96 that is connected between the outer wall portions 90. The proximal end 92 of the rib 74 is the portion of the rib 74 that extends from the inner surface 72 at a location proximate to the inner surface 72.

The middle wall portion 96 is thus disposed at a location that is laterally offset with respect to the inner surface 72 of the ground plate body 64. In accordance with the illustrated embodiment, the middle wall portion 96 defines a distal end 98 of the rib 74 that lies in the first plane T-L1. The middle wall portion 96 can include a curved portion along a direction extending normal to the signal contacts 56 that define the corresponding gap 59, or can alternatively or additionally include a flat portion along a direction extending normal to the signal contacts 56 that define the gap 59. In this regard, it should be appreciated that the middle wall portion 96 can alternatively be entirely curved along a direction extending normal to the signal contacts 56 that define the corresponding gap 59, or entirely flat along a direction extending normal to the signal contacts 56 that define the gap 59. Thus, the ribs 74 can define curvatures that vary from each other. It should thus be appreciated that the ribs 74 can be curved or tapered, and thus devoid of sharp edges that are out of plane T-L1 with respect to the differential signal contacts 56. Furthermore, each rib 74 can be spaced at a consistent distance along its length from its adjacent signal contacts 56 that define the corresponding gap 59. Moreover, each rib 74 can be spaced from its adjacent signal contacts 56 a distance that is substantially equal to the distance that one or more up to all of the other ribs 74 are spaced from their adjacent signal contacts.

While the middle wall portion 96 can lie in the first plane T-L1 as illustrated, it should be appreciated that the rib 74 could alternatively terminate at the distal end 98 which is positioned inward of, or past, the first plane T-L1. In accordance with the illustrated embodiment, the middle wall portion 96 extends at substantially a constant lateral distance LD from the inner surface 72 of the ground plate 62 that is substantially equal to the lateral distance between the second plane T-L2 and the first plane T-L1.

It should be appreciated that a portion of each rib 74 can overlap the electrical signal contacts 56 that define the corresponding gap 59 with respect to an axis extending through the signal contacts 56 in a direction perpendicular to and between the first and second planes T-L1 and T-L2. Alternatively, the ribs 74 can be wholly contained between the axes extending through the signal contacts 56 in a direction perpendicular to and between the first and second planes T-L1 and T-L2. For instance, In accordance with the illustrated embodiment, the proximal end 92 of each rib 74 is positioned inward with respect to the corresponding signal contacts 56 that define the gap 59. Accordingly, a lateral axis L1 that extends through the proximal ends 92 one or more ribs 74 also extends through the corresponding gap 59, and not one of the signal contacts 56 that defines the gap 59. Alternatively, the proximal ends 92 could be disposed outward or inline with respect to the corresponding signal contacts 56 that define the gap 59. Accordingly, the lateral axis L1 that extends through the proximal ends 92 or other locations of the rib 74 can also extend through one or both signal contacts 56 that defines the corresponding gap 59.

With continuing reference to FIGS. 4A-6C, each rib 74 can define a first width W1 extending along a direction parallel to the ground plate plane T-L2 at the proximal end 92, and a second width W2 extending along the direction parallel to the ground plate plane T-L2 at the distal end 98 that is less than the first width W1 in accordance with the illustrated embodiment. The widths W1 and W2 of at least one rib 74 can be less than, greater than, or substantially equal to one or both of the corresponding widths W1 and W2 of one or more of the other ribs 74.

Figure 8:
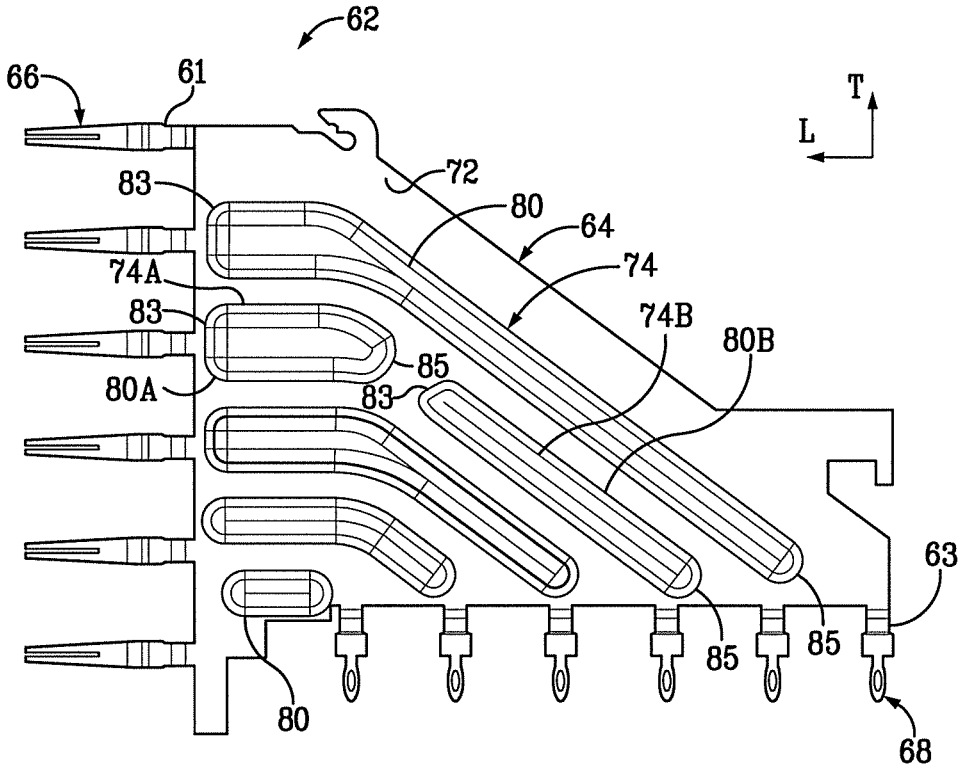
FIG. 8 is a side elevation view of a ground plate similar to the ground plate illustrated in FIG. 4B, but constructed in accordance with an alternative embodiment.

While the ribs 74 are illustrated as extending continuously from their respective front end 83 to their rear ends 85, it should be appreciated that one or more up to all of the ribs 74 can be discontinuous or segmented between the front and rear ends 83 and 85. For instance, as illustrated in FIG. 8, one or more the ribs 74 can be provided as separate rib segments 74*a* and 74*b*, each defining respective enclosed perimeters 80*a* and 80*b* spaced from each other between the corresponding mating end 66 and mounting end 68. Alternatively or additionally, the middle wall portion 96 of a given rib 74 can project a distance from the inner surface 72 that varies along the length of the rib 74 between the front end 83 and the rear end 85.

While FIGS. 6B-C show the leadframe housing 54 overmolded onto the signal contacts 56 and the ground plate 62, it should be appreciated that the signal contacts 56, the ground plate 62, or both the signal contacts 56 and the ground plate 62 can be discreetly attached to the leadframe housing 54. Furthermore, while the ground plate 62 is shown as abutting the leadframe housing 54 along its length, the ground plate 62 can alternatively be supported by the leadframe housing 54 at discrete locations of the ground plate 62, such that one or more air gaps are disposed between the housing 54 and the ground plate 62 and desired locations. For instance, an air gap between the leadframe housing 54 and the ribs 74 would allow for clearance of the ribs 74 when the ground plate 62 is attached to the leadframe housing 54. It should be further appreciated that such air gaps could further be provided when the leadframe housing 54 is overmolded onto the ground plate 62. Likewise, while the signal contacts 56 are shown as abutting the leadframe housing 54 along their length, the signal contacts 56 can alternatively be supported by the leadframe housing 54 at discrete locations of the signal contacts 56, such that air gaps are disposed between the housing 54 and the signal contacts and desired locations. It should be further appreciated that such air gaps could further be provided when the leadframe housing 54 is overmolded onto the signal contacts 56.

Figure 7A:
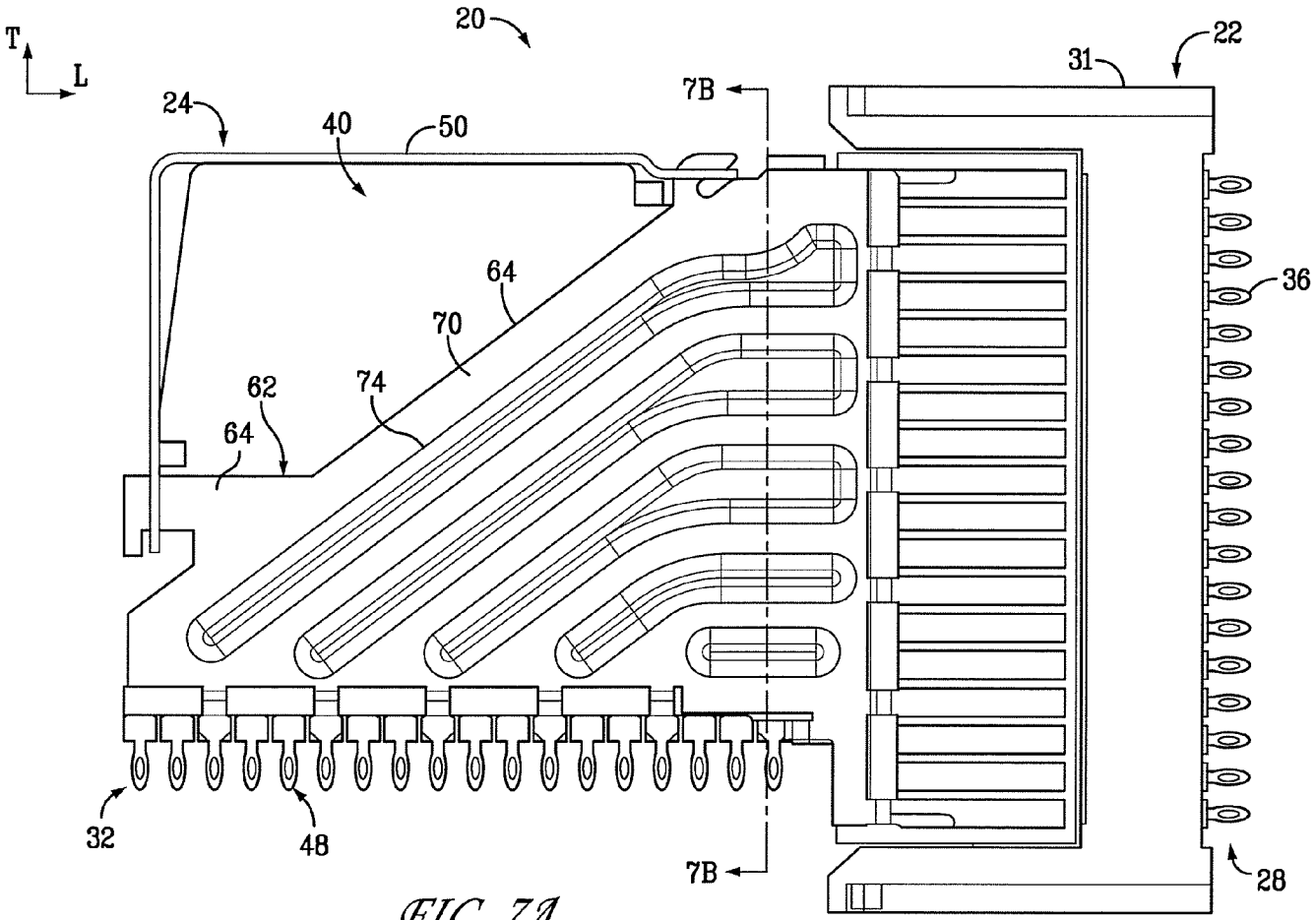
FIG. 7A is a side elevation view of the electrical connector assembly as illustrated in FIG. 2B.
Figure 7B:
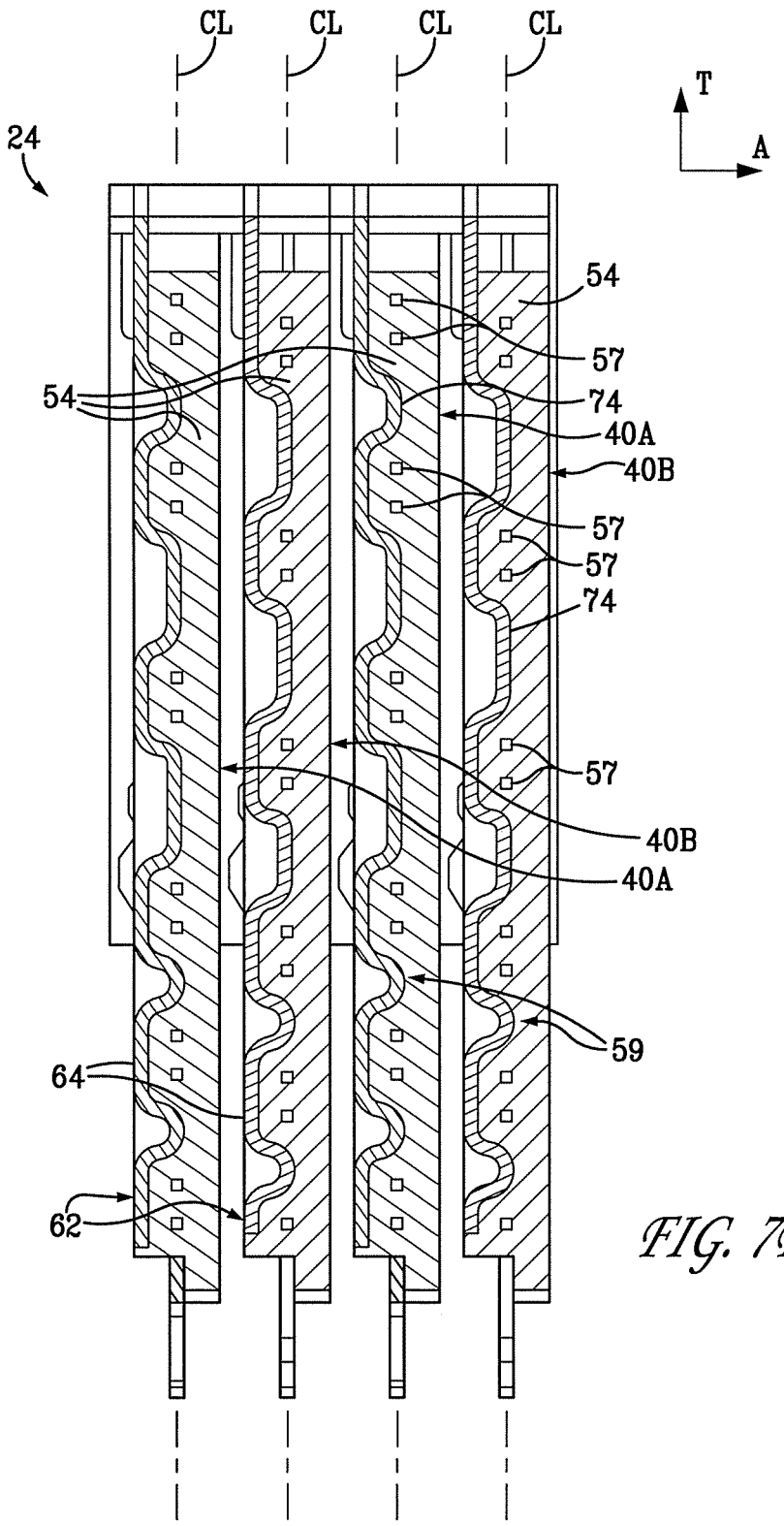
FIG. 7B is a sectional view of the electrical connector assembly illustrated in FIG. 7A, taken along line 7B-7B.

Referring now to FIGS. 7A-B, the electrical connector 24 is illustrated as including a plurality of IMLAs 40 of the type described above. Four IMLAs 40 are illustrated having electrical contacts 44 that extend along respective common centerlines CL, though it should be appreciated that the connector 24 can include as many IMLAs 40 as desired. Each IMLA can include as many electrical signal contact pairs 57 and interleaved ribs 74 as desired. Thus, one or more up to all of the IMLAs 40 can include a ground plate 62 of the type described above. The IMLAs 40 include a first-type of IMLAs 40A that are substantially identically constructed and a second type of IMLAs 40B that substantially identically constructed. The IMLAs 40A and 40B are alternately arranged along the lateral direction A. In accordance with the illustrated embodiment, the signal contacts 56 of the first IMLAs 40A are staggered with respect to the signal contacts 56 of the second IMLAs 40B. Accordingly, the gaps 59 between adjacent signal pairs 57 of the first IMLAs 40*a* are staggered with respect to the gaps 59 of the second IMLAs 40B. It should be appreciated that the mating ends 66 and mounting ends 68 can extend from any position along the ground plate body 64 as desired, such that the mating ends 66 are disposed between and aligned with the mating ends 58 of the signal contacts 56 in the manner described above, and the mounting ends 68 are disposed between and aligned with the mounting ends 60 of the signal contacts 56 in the manner described above.

For instance, in accordance with one embodiment, the mating ends 46 of the first IMLAs 40A are arranged in a repeating G-S-S-G-S-S pattern in a direction along the common centerline CL from the top of the mating interface 30 toward the bottom of the mating interface 30, whereby "G" denotes electrical ground contact mating ends 66 and "S" denotes electrical signal contact mating ends 58. Furthermore, in accordance with one embodiment, the mating ends 46 of the second IMLAs 40B are arranged in a repeating S-S-G-S-S-G pattern in a direction along the common centerline CL from the top end of the mating interface 30 toward the bottom of the mating interface 30, whereby "G" denotes electrical ground contact mating ends 66 and "S" denotes electrical signal contact mating ends 58.

It should thus be appreciated that a method of producing an electrical connector includes the steps of 1) providing a plurality of electrical signal contacts 56, 2) retaining the electrical signal contacts 56 in the leadframe housing 54 along the first plane T-L1 so as to define gaps 59 disposed between adjacent pairs of electrical signal contacts 56, 3) providing a ground plate 62 having a ground plate body 64 that defines first and second opposed surfaces 72 and 70, respectively, 4) stamping a plurality of ribs 74 into the second surface 70 of the ground plate body 64 such that the ribs 74 define first and second opposed surfaces 75 and 77, respectively, wherein the first surface 75 of each rib 74 projects out from the first surface 72 of the ground plate body 64, and the second surface 77 of each rib is recessed in the second surface 70 of the ground plate body 64, and 5) attaching the ground plate 62 to the leadframe housing 54 such that the ground plate body 64 is oriented in the second plane T-L2 that is offset with respect to the first plane T-L1, and the first surface 75 of each rib 74 projects toward a respective one of the gaps 59 defined by the adjacent pairs 57 of electrical signal contacts 56.

The ground plate 62 is a wide continuous conductor, and is wider than the ground contacts of an electrical connector that is substantially identical with respect to the electrical connector 24, with the exception that the substantially identical electrical connector does not include the ground plate 62, but instead includes discrete ground contacts extending in the gaps 59 that define opposing ground mating ends and ground mounting ends as described in U.S. Pat. No. 7,497,736. Accordingly, it should be appreciated that the electrical connector 24 can be modified with respect to substantially identical electrical connector, with the exception that the electrical connector 24 is devoid of discrete ground contacts in favor of the ground plate 62 having ribs 74 that extend between adjacent pairs 57 of signal contacts 56. Thus, the electrical connector 24 is an improvement over shieldless, high density, right-angle electrical connectors that have discrete ground contacts without significantly lowering impedance matching and without significantly increasing inductance. In accordance with embodiments of the present invention, the impedance of the electrical connector 24 is not significantly altered with respect to a pre-modified connector, inductance of the electrical connector 24 is lower than the ground contacts in the same pre-modified connector, crosstalk of the electrical connector 24 is lower as compared to the same pre-modified connector, and the overall dimensions of the electrical connector 24 are the same as those of the pre-modified connector For instance, it is believed that the ground plate 62 provides a low-impedance common path that intercepts and dissipates stray electro-magnetic energy between signal contacts 56 that otherwise would have been a source for cross talk. It is believed that a connector that incorporates the IMLAs 40 as described above can operate at 13 GHz with acceptable worst-case, multi-active crosstalk on a victim pair of no more than six percent, for instance less than one percent, such as 0.4 percent. Worst case, multi-active crosstalk may be determined in the manner described in U.S. Pat. No. 7,497,736.

The foregoing description is provided for the purpose of explanation and is not to be construed as limiting the invention. While various embodiments have been described with reference to preferred embodiments or preferred methods, it is understood that the words which have been used herein are words of description and illustration, rather than words of limitation. Furthermore, although the embodiments have been described herein with reference to particular structure, methods, and embodiments, the invention is not intended to be limited to the particulars disclosed herein. Those skilled in the relevant art, having the benefit of the teachings of this specification, may effect numerous modifications to the invention as described herein, and changes may be made without departing from the spirit and scope of the invention as defined by the appended claims.

What is claimed is:

1. An electrical connector comprising:

a dielectric housing;

a plurality of electrical signal contacts that are carried by the dielectric housing, and that are arranged along a first plane that extends along both a first direction, and a second direction that is perpendicular to the first direction, wherein the electrical signal contacts define respective mating ends, respective mounting ends, and electrical signal pairs such that a respective gap is disposed between adjacent electrical signal pairs;

a ground plate carried by the dielectric housing, the ground plate including a ground plate body oriented in a second plane that is substantially parallel to the first plane and offset from the first plane, the ground plate body defining first and second opposed surfaces, the ground plate including respective mating ends and respective mounting ends that extend from the ground plate body and are disposed in the first plane, and the ground plate including a plurality of ribs that are fully contained in the ground plate body and that define first and second opposed surfaces, wherein the first surfaces of the ribs project from the first surface of the ground plate body in a direction toward the gap, the second surfaces of the plurality of ribs are recessed into the second surface of the ground plate body, the respective mounting ends extend from the ground plate body along the first direction, and at least one of the mounting ends is in-line with at least one of the plurality of ribs along the first direction;

wherein the electrical signal pairs comprise differential pairs and the plurality of ribs function as ground contacts between respective adjacent differential pairs.

2. The electrical connector as recited in claim 1, wherein the dielectric housing is a leadframe housing over molded onto the electrical signal contacts.

3. The electrical connector as recited in claim 2, wherein the ground plate is discretely attached to the leadframe housing.

4. The electrical connector as recited in claim 1, wherein at least one of rib of the plurality of ribs is embossed into the ground plate and the at least one rib defines a curved outer wall portion.

5. The electrical connector as recited in claim 1, wherein at least one rib of the plurality of ribs extends along a length that is different with respect to at least one other rib of the plurality of ribs.

6. The electrical connector as recited in claim 1, wherein each of the at least one rib and the at least one other rib of the plurality of ribs has a portion that is disposed in the first plane, and the portion of the at least one rib that is disposed in the first plane has a curvature that is different than the portion of the at least one other rib of the plurality of ribs disposed in the first plane.

7. The electrical connector as recited in claim 1, wherein at least one rib of the plurality of ribs is segmented.

8. The electrical connector as recited in claim 1, wherein the electrical connector has the same overall dimension as a substantially identically constructed electrical connector that does not include the ground plate and instead includes a discrete electrical ground contact disposed in the gap.

9. The electrical connector as recited in claim 1, wherein the electrical signal contacts are right-angle contacts.

10. The electrical connector as recited in claim 1, wherein at least a portion of at least one of the ribs extends along a direction that is angularly offset with respect to the first and second directions.

11. The electrical connector as recited in claim 1, wherein at least one of the ribs has a first terminal end, and a second terminal end that is offset from the first terminal end with respect to the first direction so as to be positioned closer to the mounting ends of the ground plate than the first terminal end.

12. An electrical connector comprising:

an organizer; and a plurality of insert molded leadframe assemblies retained by the organizer, each insert molded leadframe assembly including:

a dielectric housing;

a plurality of electrical signal contacts carried by the dielectric housing and arranged along a first plane that extends along both a first direction, and a second direction that is perpendicular to the first direction, wherein the signal contacts are arranged in pairs such that respective gaps are disposed between adjacent pairs of signal contacts, the signal contacts defining respective mating ends and mounting ends; and a ground plate carried by the dielectric housing, the ground plate including a ground plate body oriented in a second plane that is substantially parallel to the first plane and offset from the first plane, the ground plate body defining first and second opposed surfaces, the ground plate including:

a plurality ribs that are each embossed in the ground plane, that are each fully contained in the ground plate body, and that each define first and second opposed surfaces, wherein the first surface of each rib projects from the first surface of the ground plate body in a direction toward a respective one of the gaps, and the second surface is recessed into the second surface of the ground plate body;

a plurality of mating ends that extend from the ground plate body and that are offset from the ground plate body so as to extend in the respective gaps in the first plane aligned with the mating ends of the electrical signal contacts; and a plurality of mounting ends that extend from the ground plate body along the first direction and that are offset from the ground plate body so as to extend in the respective gaps in the first plane aligned with the mounting ends of the electrical signal contacts, wherein at least one of the mounting ends is in-line with at least one of the plurality of ribs along the first direction; and wherein the electrical signal pairs comprise differential pairs and the plurality of ribs function as ground contacts between respective adjacent differential pairs.

13. The electrical connector as recited in claim 12, wherein the plurality of insert molded leadframe assemblies includes a first type of insert molded leadframe assembly and a second type of insert molded leadframe assembly alternately arranged wherein the signal contacts of the first type of insert molded leadframe assembly are staggered with respect to the signal contacts of the second type of insert molded leadframe assembly.

14. The electrical connector as recited in claim 12, wherein each rib takes place of a ground contact between the adjacent pairs of signal contacts.

15. The electrical connector as recited in claim 12, wherein at least a portion of at least one of the ribs extends along a direction that is angularly offset with respect to the first and second directions.

16. The electrical connector as recited in claim 12, wherein at least one of the ribs has a first terminal end, and a second terminal end that is offset from the first terminal end with respect to the first direction such that the second terminal end is positioned closer to the mounting ends of the ground plate than the first terminal end.

* * * * *